US009949023B2

(12) United States Patent
Astgimath et al.

(10) Patent No.: US 9,949,023 B2
(45) Date of Patent: Apr. 17, 2018

(54) BIASING CIRCUITRY FOR MEMS TRANSDUCERS

(71) Applicant: Cirrus Logic International (UK) Limited, Edinburgh (GB)

(72) Inventors: Santosh Astgimath, Edinburgh (GB); Jean Pierre Lasseuguette, Edinburgh (GB); John Laurence Pennock, Juniper Green (GB)

(73) Assignee: Cirrus Logic, Inc., Austin, TX (US)

( * ) Notice: Subject to any disclaimer, the term of this patent is extended or adjusted under 35 U.S.C. 154(b) by 168 days.

(21) Appl. No.: 14/574,714

(22) Filed: Dec. 18, 2014

(65) Prior Publication Data

US 2015/0181352 A1 Jun. 25, 2015

(30) Foreign Application Priority Data

Dec. 19, 2013 (GB) ..... 1322496.9

(51) Int. Cl.
*H04R 3/00* (2006.01)
*H04R 19/00* (2006.01)
*H04R 19/04* (2006.01)

(52) U.S. Cl.
CPC ..... *H04R 3/00* (2013.01); *H04R 19/005* (2013.01); *H04R 19/04* (2013.01)

(58) Field of Classification Search
CPC . G05F 3/265; G05F 3/16; G05F 1/461; G05F 1/10; G05F 3/267; G05F 1/46; H02M 3/073; H02M 3/07; H04R 19/04; H04R 2201/003; H04R 3/00; H04R 19/005; H04R 19/00; H04R 1/005; H04R 29/004
See application file for complete search history.

(56) References Cited

U.S. PATENT DOCUMENTS 6,462,526 B1 * 10/2002 Tanase ..... G05F 3/30 323/313
6,891,358 B2 * 5/2005 Marinca ..... G05F 3/30 323/315

(Continued)

*Primary Examiner* — Fan Tsang
*Assistant Examiner* — Angelica M McKinney
(74) *Attorney, Agent, or Firm* — Jackson Walker L.L.P.

(57) ABSTRACT

Circuitry for biasing a MEMS transducer and associated signal processing circuitry. A reference voltage generator is configured to generate a reference voltage at a reference voltage node. Control circuitry generates a drive signal to control a first current source which is operable to supply a current to the reference voltage generator in response to the drive signal. A switched DC-DC converter, such as a charge pump has a voltage input connected to the reference voltage node and a voltage output for providing a bias voltage for the MEMS transducer. The DC-DC converter cyclically switches in a sequence of states including at least a first state where a first converter capacitance is disconnected from the voltage input followed by a second state where the first converter capacitance is connected to the voltage input. A second current source is operable to supply a bias current in response to a voltage at a bias control node. Switch control circuitry is configured to cyclically open and close a switch connected between the drive node and the bias control node, such that the switch is open during a time window that includes the time at which the switched DC-DC converter switches from the first state to the second state.

44 Claims, 9 Drawing Sheets

(56) References Cited

U.S. PATENT DOCUMENTS 6,958,594 B2 * 10/2005 Redl ..... H02M 3/156 323/282
8,089,289 B1 * 1/2012 Kremin ..... G01D 5/24 324/658
8,120,415 B2 * 2/2012 Conte ..... G05F 3/30 327/539
8,582,787 B2 11/2013 David et al.
8,698,479 B2 * 4/2014 Tung ..... G05F 3/30 323/313
2005/0140415 A1 * 6/2005 Hazucha ..... H03K 5/135 327/276
2007/0170981 A1 * 7/2007 Burt ..... H03F 1/26 330/9
2009/0039959 A1 * 2/2009 An ..... H03F 3/3022 330/255
2010/0102794 A1 * 4/2010 Erbito, Jr. ..... G05F 3/30 323/313
2010/0188141 A1 * 7/2010 Aruga ..... G05F 3/30 327/539
2011/0278952 A1 * 11/2011 Reimann ..... H02M 3/07 307/109
2012/0019303 A1 * 1/2012 Singh ..... H02M 1/14 327/333
2012/0056677 A1 * 3/2012 Zhu ..... H03F 1/0233 330/296
2012/0062244 A1 * 3/2012 Santana ..... G01D 5/24 324/658
2013/0279721 A1 * 10/2013 David ..... G05F 1/467 381/123
2013/0287231 A1 * 10/2013 Kropfitsch ..... H02M 3/073 381/113
2014/0015509 A1 * 1/2014 Gupta ..... G05F 3/30 323/313
2014/0079254 A1 3/2014 Kim et al.
2015/0018678 A1 * 1/2015 Komuro ..... A61B 8/12 600/437

* cited by examiner

BIASING CIRCUITRY FOR MEMS TRANSDUCERS

BACKGROUND OF THE INVENTION

1. Field of the Invention

This application relates to biasing circuitry for MEMS transducers, in particular to biasing circuitry comprising a reference circuit such as a bandgap reference circuit and a DC-DC converter such as a charge pump.

2. Description of the Related Art

MEMS transducers such as MEMS capacitive transducers, for instance MEMS microphones, typically comprise two plates which are movable with respect to one another, for example a fixed plate and a moveable membrane. A stimulus, such as an acoustic pressure wave in the case of a microphone, can vary the distance between the plates of the MEMS transducer resulting in a capacitance that varies in accordance with the stimulus. In use a bias voltage is typically applied across the varying capacitance to provide a consequently varying electrical signal voltage or charge which can be measured. For MEMS transducers the overall capacitance of the transducer is small, typically of the order of 1 pf or so, and the change in capacitance is typically less than 1%. Thus a sensitive low-noise preamplifier is required to buffer the measured signal, i.e. the signal from the transducer.

MEMS microphone transducers are typically designed to require a bias voltage of around 12V. This is larger than the power supply voltages used for amplifiers and other electronic circuitry, so the bias voltage may be generated and supplied by a suitable DC-DC converter, typically a switched DC-DC converter such as a charge pump.

FIG. 1 illustrates an example of a typical arrangement of pre-amplifier circuitry for a MEMS sensor 100. A first terminal of MEMS transducer 101 is arranged to receive a bias voltage $V_{CP}$, typically 12V or so, from a charge pump 102. An amplifier 103 has an input connected to the other terminal of the MEMS transducer. This terminal is also connected to a high-value (typically of the order of 10 Gohm or greater) bias resistance $R_G$ 104 to bias this terminal to ground without shorting out the audio band signal. The bias resistance 104 may often be implemented in the form of polysilicon diodes.

The charge pump 102 is arranged to generate the required relatively high bias voltage $V_{CP}$ from a lower voltage input. Typically the charge pump 102 generates a bias voltage $V_{CP}$ which is equal to a multiple of the voltage applied to its input. It will be appreciated therefore that were the charge pump input connected directly to the voltage supply for an integrated circuit, then the bias voltage across the transducer would vary with the applied supply voltage. Also any noise on the supply would be similarly multiplied and couple via the MEMS capacitance into the amplifier 103 and would be indistinguishable from any acoustically generated signals. Thus the voltage input for the charge pump 102 is preferably a supply-independent voltage $V_R$. Typically this reference voltage $V_R$ is generated by a reference generator circuit 105 which will typically include a bandgap voltage reference generator. As will be understood by one skilled in the art a bandgap voltage reference generator can generate a reference voltage that is independent of variations of the supply voltage and which is also substantially temperature stable.

The power supply rejection of the amplifier circuit is also important to avoid coupling of supply noise into the signal path, so preferably the amplifier 103 is supplied with a supply-independent reference current, i.e. bias current IB, which also advantageously allows the supply current to be optimised without having to allow extra margin for the tolerance in supply voltage. Conveniently the reference voltage $V_R$ and the bias current $I_B$ are both supplied from the same reference generator circuit 105.

FIG. 2 illustrates one example of bandgap reference generation circuitry 105. To provide the bandgap reference voltage $V_{BG}$, bipolar transistors Q1 and Q2 are configured to run at different current densities $J_1$, $J_2$, giving rise to a difference in their base-emitter voltages, $V_{be}$, equal to $(kT/q)\cdot\ln(J_2/J_1)$. Control circuitry 201 equalises the voltages at nodes A and B, resulting in this temperature-proportional voltage being imposed across a resistor R1, which thus passes a current $I_{PTAT}$ which is proportional to temperature. The equality is possible for only one non-zero current $I_{PTAT}$ through node A and the corresponding current through node B, which the control circuitry establishes by controlling at least one current source 202 to deliver a current $I_{XA}$. This current is supply-independent, and thus may be mirrored to provide a supply-independent output current $I_{XB}$ for use by the amplifier circuit 103.

The base-emitter voltage $V_{be}$ of Q2 (or Q1) has a physically determined negative temperature coefficient of magnitude about 2 mV/K. The circuit is configured so that the negative temperature dependence of the transistor base-emitter voltage $V_{be}$ at least partially offsets a positive temperature coefficient due to the temperature-proportional current flowing through appropriate resistances. In other words, through choice of an appropriate resistive scaling factor $R_x$ and current $I_{PTAT}$, an output voltage $V_{BG}=V_{be}+R_x\cdot I_{PTAT}$ is provided with a zero (or at least smaller) net temperature coefficient.

Such a bandgap reference circuit 105 thus provides a supply independent current and a supply independent voltage $V_{BG}$ that is relatively temperature stable. It is not typically possible however to use such a reference voltage $V_{BG}$ directly as an input to a charge pump as the charging current pulses drawn by the charge pump cannot be supplied without disturbing the operation of the bandgap reference circuit 105. Typically therefore the reference voltage $V_{BG}$ which is produced by the bandgap reference voltage generator 105 may be buffered by a suitable voltage buffer and this buffered reference voltage $V_{BBG}$ is provided as the input voltage to the charge pump.

In MEMS sensor applications however there are often pressures on the cost and size of the sensor circuitry and thus it would be desirable to be able to reduce the size of the sensor circuitry where possible.

Such MEMS sensors are also often used in battery powered device where power consumption is always a concern, especially in the case of MEMS microphones which may be used for relatively long periods of time, for instance to allow for input of voice commands. Thus, the supply current for a pre-amplifier circuit for a MEMS microphone is an important consideration and should be kept as low as possible.

Embodiments of the present invention therefore provide biasing circuitry for MEMS transducers that address at least some of the issues mentioned above.

SUMMARY OF THE INVENTION

Thus according to the present invention there is provided biasing circuitry for biasing a MEMS transducer and associated signal processing circuitry, comprising:

a reference voltage generator for generating a reference voltage at a reference voltage node, said reference voltage generator comprising control circuitry for generating a first drive signal at a drive node;

a first current source, the first current source being operable to supply a first current to the reference voltage generator in response to said first drive signal at said drive node;

a switched DC-DC converter having a voltage input connected to said reference voltage node and a voltage output for providing a bias voltage for said MEMS transducer, said DC-DC converter being operable in use to cyclically switch in a sequence of states including at least a first state where a first converter capacitance is disconnected from the said voltage input followed by a second state where said first converter capacitance is connected to said voltage input;

a second current source, the second current source being operable to supply a bias current to a bias current output in response to a voltage at a bias control node;

a first switch connected between said drive node and said bias control node; and switch control circuitry configured to control said first switch in use when said second current source is providing said bias current to cyclically open and close said first switch such that the first switch is open during a time window that includes the time at which the switched DC-DC converter switches from the first state to the second state.

The first switch is open at the transition from the first charge pump state to the second charge pump state such that following the transition the second current source, which provides the bias current, is isolated from the drive node. This isolates the second current source, and hence the bias current, from a possible transient at the drive node. The first switch is thus open during a time window that includes the time at which the switched DC-DC converter switches from the first state to the second state. It should be noted that the start of the time window may be synchronous with the switching from the first state to the first state and the term includes shall be construed accordingly.

In some embodiment there may be a first bias control capacitor connected to the bias control node so as to maintain the voltage of the bias control node when the first switch is open. The first bias control capacitor may be connected between a voltage supply for the second current source.

The switch control circuitry may be configured to provide a first clock signal for controlling said first switch. The first clock signal may have a predetermined relationship to a control clock signal for the switched DC-DC converter, for instance the first clock signal may be twice the frequency of the control clock signal. In some instances there may be a predetermined phase difference between the first clock signal and the control clock signal such that each rising edge and/or each falling edge of the control clock signal occurs during a period when the first switch is open. In some embodiments the switch control circuitry is configured to provide the control clock signal for the switched DC-DC converter. The switch control circuitry may have an input for receiving an externally generated clock signal and be configured to generate the first clock signal and the control clock signal from the externally generated clock signal.

In some embodiments there may be a second switch in series between the first switch and the bias control node. The second switch may be controlled in anti-phase with the first switch. There may a first bias control capacitor connected between a voltage supply for the second current source and the bias control node and a second bias control capacitor connected between the voltage supply for the second current source and a node which is between the first and second switches.

The bias current source may comprise a transistor.

In some embodiments there may be a feedback capacitor connected between the voltage output and a control node of the control circuitry of the reference voltage generator. The control circuitry may comprise a differential transconductance stage and the control node may be an input to the differential transconductance stage.

In some embodiments a shunt load capacitor may be connected between the voltage output of the reference voltage generator and a common voltage terminal.

The DC-DC converter may also be operable to switch from a third state in which the voltage input is disconnected from a second converter capacitance to a fourth state where the second converter capacitance is connected to the voltage input. In this case the switch control circuitry may be configured to control the first switch in use such that the first switch is also open during a time window that includes the time at which the switched DC-DC converter switches from the third state to the fourth state. For some embodiments the fourth state is the same state as the first state and/or the second state is the same state as the third state.

In some embodiment there may be a filter connected between said first switch and said second current source. The filter may be connected between the bias control node and the second current source. The filter may comprise at least one polysilicon diode and at least one capacitor and may, for example, comprise two polysilicon diodes connected to be antiparallel to one another. There may also be a bypass switch connected in parallel with the filter for bypassing the filter.

In some embodiment the first current source is further operable to supply a bias current to said bias current output and said second current source is also operable to supply said first current to the reference voltage generator. The circuitry may therefore comprise a first chopper switch circuit associated with the first current source and a second chopper switch circuit associated with the second current source. Each chopper switch circuit may be operable to selectively provide a current produced by the respective current source to the control circuitry of the reference voltage generator or to a bias current output. The first and second chopper switch circuits may be configured to be switched by clock signals which are in phase with a control clock signal used to control switching of the switched DC-DC converter. The circuitry may therefore comprise a second switch between the drive node and a control node of the first current source and the switch control circuitry may be configured to control the second switch in use, when said first current source is providing the bias current, to cyclically open and close said second switch such that the second switch is open during a time window that includes the time at which the switched DC-DC converter switches from the first state to the second state. The switch control circuitry may control the first and second switches such that: for each transition of the DC-DC converter from the first state to the second state, at least one of the first and second switches is open during a time window that includes the time of said transition; wherein: at least the second switch is open, if following said transition the first current source will provide the bias current; and at least the first switch is open, if following said transition the second current source will provide the bias current. A second bias control capacitor may be provided for maintaining the voltage of a control node of the first current source when the second switch is open.

The associated signal processing circuitry may comprise an amplifier. The circuit may also comprise a MEMS transducer and/or signal processing circuitry associated with the/a MEMS transducer connected to be biased by said biasing circuitry.

The biasing circuit may therefore form part of control circuitry for a MEMS transducer comprising biasing circuitry as described herein for generating a biasing voltage for biasing the MEMS transducer and amplifier circuitry for amplifying a measurement signal from said MEMS transducer, wherein the bias current generated by said bias current source is provided to said amplifier circuitry.

The biasing circuitry may be implemented as an integrated circuit, possibly together with the signal processing circuitry. In some embodiments the MEMS transducer may be on a discrete circuit which is bonded to the IC having the biasing circuitry. In other embodiments however the MEMS transducer may be formed on a monolithic substrate with the biasing circuitry.

Embodiment of the invention may be used in an electronic device which may be at least one of: a portable device; a battery powered device; a computing device; a communications device; an audio device; a personal media player; a games device; a mobile telephone; a laptop computer and a tablet computing device.

In another aspect there is provided a method of biasing a MEMS transducer and associated signal processing circuitry, the method comprising:

generating, using a reference voltage generator, a reference voltage at a reference voltage node, wherein generating said reference voltage comprises generating a first drive signal at a drive node to control a first current source supplying a first current to the reference voltage generator;

operating a switched DC-DC converter having a voltage input connected to said reference voltage node to provide a bias voltage for said MEMS transducer at a voltage output node, wherein operating said DC-DC converter comprises cyclically switching in a sequence of states including at least a first state where a first converter capacitance is disconnected from the said voltage input followed by a second state where said first converter capacitance is connected to said voltage input; and controlling a second current source current source to supply a bias current to a bias current output by controlling a voltage at a bias control node;

wherein controlling said second current source comprises operating a first switch connected between said drive node and said bias control node to cyclically open and close said first switch such that the first switch is open during a time window that includes the time at which the switched DC-DC converter switches from the first state to the second state.

The method may be implemented in any of the variants described above in relation to the first aspect of the invention.

In another aspect of the invention there is provided biasing circuitry for a MEMS transducer and associated signal processing circuitry, comprising a reference voltage generator for generating a reference voltage at a reference voltage node, the reference voltage generator comprising control circuitry for generating a first drive signal at a drive node to control a first bias current source to supply a first current;

a switched DC-DC converter, for generating a bias voltage for biasing said MEMS transducer, comprising at least a first converter capacitance coupled via at least a first converter switch to the reference voltage node;

a second bias current source controlled by a voltage at a bias current control node;

a second switch coupled between the bias current control node and the drive node; and switch control circuitry configured to:

provide a first switch control signal to said first converter switch to cyclically disconnect and reconnect the reference voltage node and said converter capacitance; and provide a second switch control signal to said second switch to cyclically open and close the second switch such that the second switch is open during a time window that includes the instant when the reference voltage node is reconnected to the converter capacitance.

In a yet further aspect there is provided biasing circuitry for a MEMS transducer comprising: a reference voltage generator comprising a reference voltage output and a bias current control output; a switched DC-DC converter comprising a first converter capacitance coupled to said reference voltage output via a first converter switch and operable in a repeating switch cycle where said first converter switch is on for part of the cycle and off for part of the cycle; a bias current source coupled to said bias current control output via a second switch; and switch control circuitry configured to turn off said second switch for a portion of each cycle overlapping the instant each cycle when first converter switch is turned on.

Also provided is bias generation circuitry, for biasing a MEMS transducer and associated signal processing circuitry, comprising: a reference voltage generator for generating a reference voltage ($V_{BG}$) at a reference voltage node and a control voltage for a current source at a control voltage node; a switched DC-DC converter for having an input connected to said reference voltage node and an output for outputting a bias voltage for biasing said MEMS transducer, said converter comprising at least one converter capacitor coupled via a first switch to input, wherein said first switch is operated cyclically by a first switch control signal so as cyclically recharge said at least one converter capacitor; a first current source coupled to said control voltage node via a second switch, said first current source being configured to provide a bias current to said signal processing circuitry; and switch control circuitry configured to open and close said second switch; wherein the disconnection of said control voltage node and said bias control node persists during a period of time that includes the instant in time when said first switch is operated to start recharging said at least one converter capacitor.

Aspects of the invention also relate to bandgap reference voltage generation circuitry comprising: a voltage output node; a first circuit branch comprising a first resistor being connected between the voltage output node and a first control node and a first bipolar being connected between the first control node and a common node; a second circuit branch comprising a second resistor being connected between the voltage output node and a second control node and a third resistor and a second bipolar transistor being connected between the second control node and the common node; the first and second resistors being equal in value and the first and second bipolar transistors being configured to operate at different current densities to one another; control circuitry for monitoring the voltages at the first and second control nodes and controlling the current through the first and second circuit branches to equalize the voltage at the first and second control node; and a first capacitor connected between the voltage output node and one of said first and second control nodes.

There may also be a second capacitor connected between the voltage output node and the common node.

BRIEF DESCRIPTION OF THE DRAWINGS

The invention will now be described by way of example only with respect of the following drawings, of which.

DETAILED DESCRIPTION OF THE PREFERRED EMBODIMENTS

Figure 2:
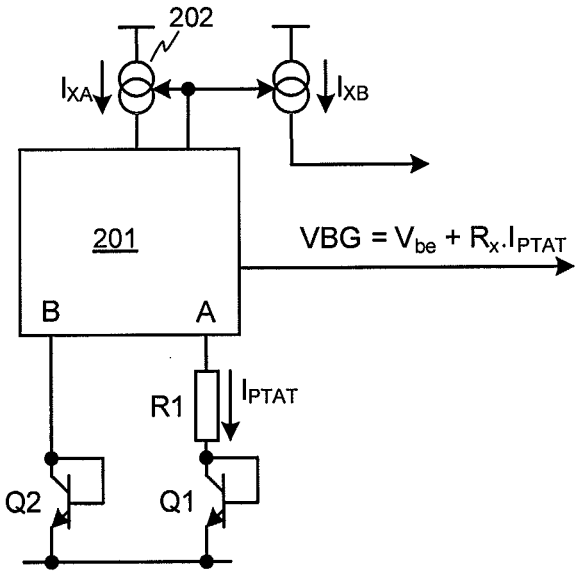
FIG. 2 illustrates one example of a bandgap reference voltage generator.
Figure 3:
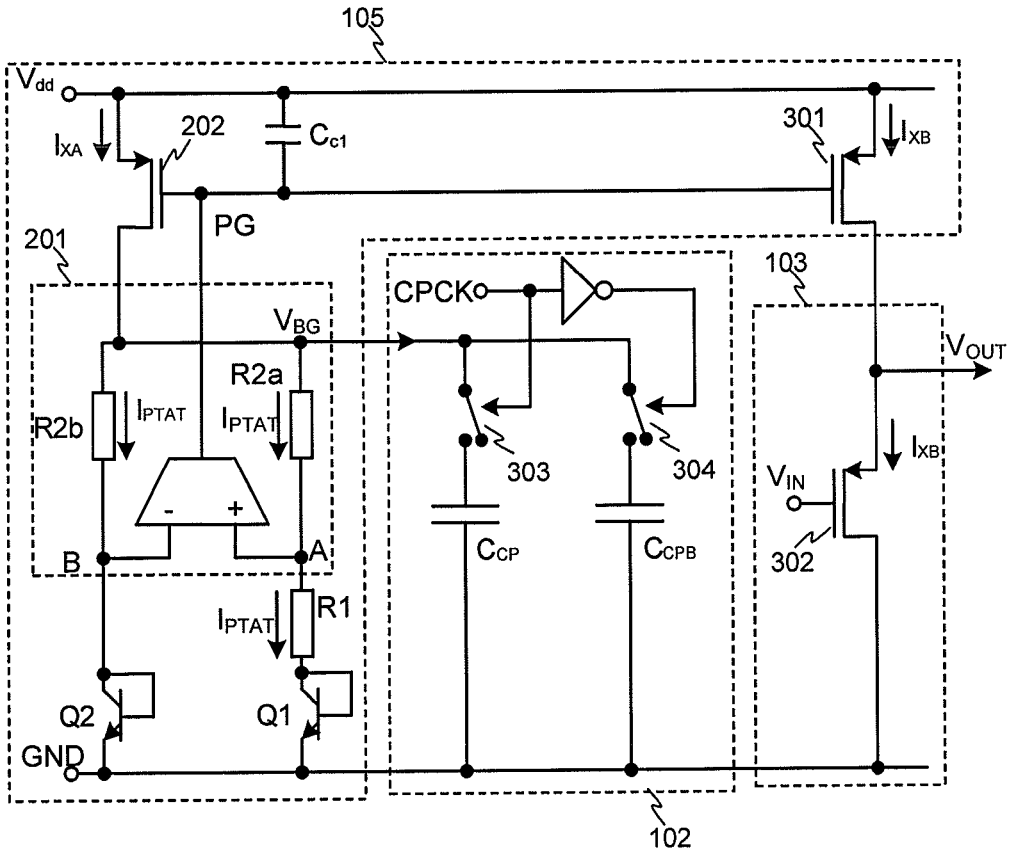
FIG. 3 illustrates the principles of a bandgap reference voltage generator directly driving a charge pump and also providing a biasing current for a signal amplifier.

FIG. 3 illustrates an example of a reference circuit in the form of a bandgap based reference circuit for a MEMS transducer, similar to that described above with respect to FIG. 2 but in more detail. In this example the control circuitry 201 comprises a differential input transconductance stage, e.g. a differential long-tailed pair, which controls the gate voltage $V_{PG}$, at a drive node PG, and hence the drain current $I_{XA}$ of PMOS transistor 202. This current $I_{XA}$ is fed back via matched resistors R2*a* and R2*b*, each of value R2. This feedback current imposed on the different impedances to ground at nodes A and B serves to equalise the voltages at nodes A and B and while providing equal currents though bipolar transistors Q1 and Q2. As mentioned above Q1 and Q2 are of different sizes so run at different current densities, so a PTAT (proportional-to-absolute-temperature) current $I_{PTAT}$ passes through R1 and R2*a*. Thus $V_{BG}$ equals $V_{be}$(Q1)+(R1+R2)·$I_{PTAT}$. A capacitance $C_{c1}$ between the supply voltage Vdd and the output of the transconductance stage may serve to introduce a dominant pole to stabilise the feedback loop.

As described previous the supply independent current $I_{XA}$ is mirrored, e.g. via transistor 301, to provide a reference, i.e. bias, current $I_{XB}$. FIG. 3 shows this bias current $I_{XB}$ being supplied to amplifier circuitry 103 for amplifying the measured signal received from the transducer. In this example the amplifier circuitry 103 comprises a simple Class A source follower amplifier, with output transistor 302, which buffers the measured signal $V_{IN}$ from the MEMS transducer so as to produce a buffered output signal $V_{OUT}$.

FIG. 3 also illustrates the reference bandgap voltage $V_{BG}$ being used to directly provide a reference input voltage to a switched DC-DC converter, which in this example is a charge pump 102. FIG. 3 illustrates the bandgap reference voltage $V_{BG}$ driving a capacitance $C_{CP}$ representing part of the charge pump circuitry connected when a charge pump clock CPCK is high. Also shown is a further capacitance $C_{CPB}$ representing a further part of the charge pump circuitry connected when charge pump clock CPCK is low. It will be appreciated that FIG. 3 illustrates a model of charge pump circuitry and illustrates the bandgap reference voltage $V_{BG}$ being switched, by switches 303 and 304, between the two capacitances at a rate based on the clock signal CPCK. The charge pump 102 itself could, for example be based on the Dickson type charge pump. Thus the charge pump can be seen as having two states, a first state where capacitance $C_{CP}$ is disconnected from the input voltage and is being used to source energy into the charge pump and a second state where the capacitance $C_{CP}$ is connected to the input voltage to be recharged. In this example the capacitance $C_{CPB}$ is connected to be recharged in the first state and disconnected in the second state. It will be appreciated however that in some charge pumps there may be more than two states and/or in at least one state there may be no recharging of any capacitance of the charge pump.

It can be appreciated that when switch 303 is open, i.e. off, in the first state the capacitance $C_{CP}$ will be partially discharged (the discharge path is omitted from FIG. 3 for simplicity) as it sources energy into the charge pump 102. Thus when reconnected in the second state, $V_{BG}$ will be pulled down to this partially discharged capacitor voltage until the feedback loop can recover the reference voltage $V_{BG}$. In order to recover the reference voltage $V_{BG}$, the current through PMOS 202 must be increased by the feedback loop until enough charge has been supplied to the charge pump load $C_{CP}$. Thus there will be a transient on drive node PG and the output reference current $I_{XB}$ will also experience a similar transient current increase. Likewise when switch 304 connects (following the transition from the second state to the first state) capacitance $C_{CPB}$, which will have been partially discharged, the reference voltage $V_{BG}$ will again be pulled downwards. Thus, in this example there will be a transient at each half period of the charge pump clock signal CPCK. It will of course be appreciated that other designs of reference circuits and/or switched DC-DC converters, e.g. charge pumps, may involve slightly different switching scenarios. In all cases however the input voltage ($V_{BG}$) to the charge pump 102 will, at least once during a full switching cycle, be used to charge an energy storage device that may be partially depleted during the cycle. In general therefore for a given capacitance of the charge pump there may be a first state where that capacitance is disconnected from the input voltage and discharging followed by a second state where it is connected to the input voltage to be recharged.

Figure 4:
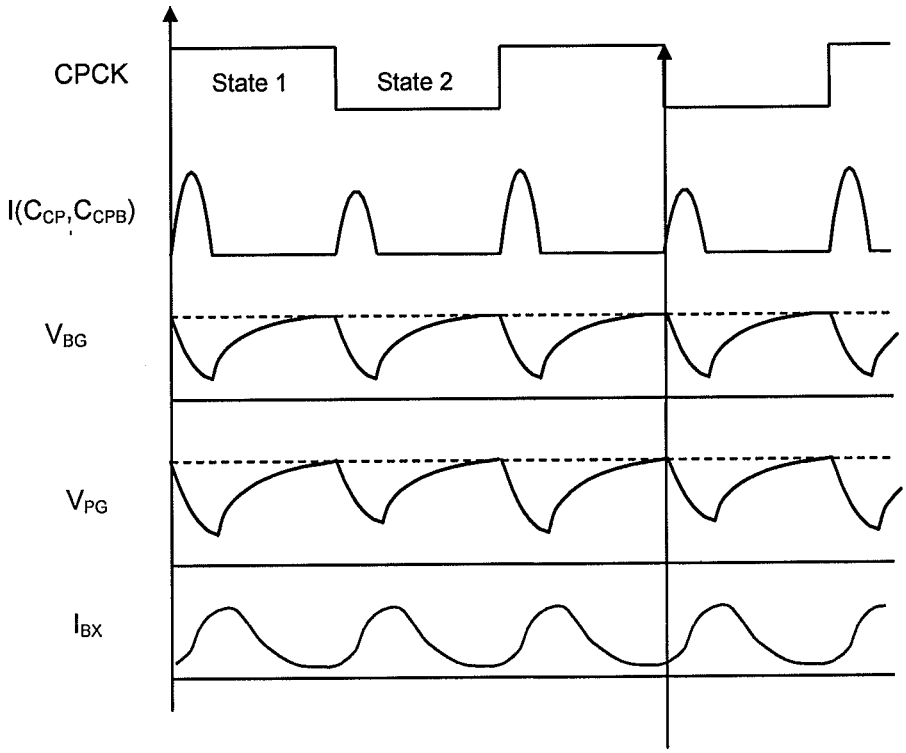
FIG. 4 illustrates example waveforms experienced in the operation of the circuit of FIG. 3.

FIG. 4 illustrates various waveforms that would be expected in operation of the circuit of FIG. 3. It can be seen that at the rising or falling edge of each CPCK clock pulse, when the clock signal transitions and one of the capacitances, $C_{CP}$ or $C_{CPB}$, is connected there will be a respective charging current $I_{CP}$, $I_{CPB}$ flow to recharge the relevant capacitance. This pulls the reference voltage $V_{BG}$ down which also affects the voltage ($V_{PG}$) at node PG and thus results in an unwanted transient in the bias current output $I_{XB}$.

Such a transient is undesirable in this circuit arrangement, as it will modulate the bias current of the low-noise amplifier 103 and thus couple into the signal path creating undesirable noise.

For the source follower amplifier 103 shown in FIG. 3, if the output transistor 302 is dimensioned to give the same net gate drive ($V_{GS}-V_T$) as the $I_{XB}$ transistor 301, then any modulation of the PMOS 202 gate-source voltage, i.e. $Vdd-V_{PG}$, will appear at roughly unity gain as an output voltage modulation. Voltage headroom constraints make it difficult to ratio these transistor dimensions to obtain an attenuation of even a factor of ten. Given that for a typical MEMS microphone an input audio stimulus of the order of 94 dBSPL (which may represent a peak input level during normal expected operating conditions) may correspond to a measured signal of the order of 12 mV rms, it will be appreciated that an unwanted voltage modulation even of the order of millivolts is clearly an issue. Indeed where the measured input signal $V_{IN}$ comes from low-capacitance sensor, of capacitance comparable to the inherent gate-source capacitance $C_{gs}$ of the source follower transistor 302, then the measured signal $V_{IN}$ will also be modulated by capacitive coupling via $C_{gs}$, thus supplying extra $C_{gs}\cdot\Delta V_{gs}$ channel charge, so that the resulting buffered measured signal output voltage $V_{OUT}$ ripple may be even worse.

Figure 5A:
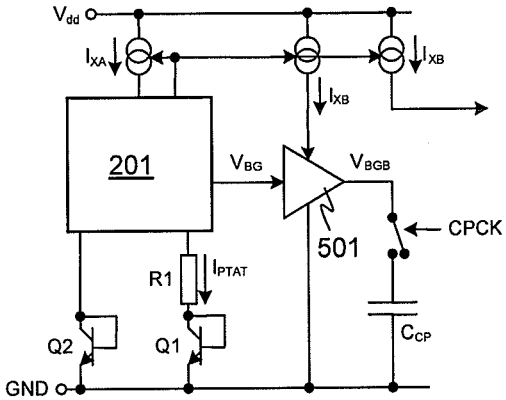
FIGS. 5*a* and 5*b* illustrate possible circuit arrangements for biasing circuitry for MEMS transducers.

As mentioned previously in conventional biasing circuits the reference voltage, i.e. $V_{BG}$, output from the bandgap voltage reference generator 105 is buffered by a suitable buffer stage. In such an arrangement the problem discussed above is avoided. FIG. 5*a* illustrates a buffer stage 501 between the bandgap reference generator 105 and the charge pump 102. This avoids loading the output voltage ($V_{BG}$) node of the reference bandgap generator 105 and the charging current is supplied by the buffer 501. However the use of buffer 501 will add to the size and cost of the biasing circuitry and the buffer 501 will require a bias current thus adding to the power consumption of the biasing circuitry.

Figure 5B:
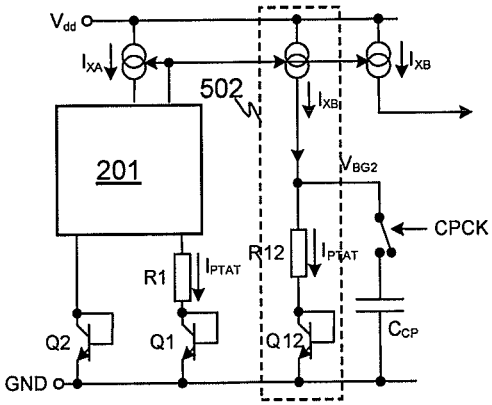

Alternatively, instead of using a buffer stage 501 it is also possible, as illustrated in FIG. 5*b*, to pass a mirrored bias current through a duplicate output stage 502, which includes resistance R12 and transistor Q12 which duplicate the resistance R1 and transistor Q1 respectively, but which is divorced from the feedback loop. This arrangement however, like the use of a buffer 501, requires an extra circuit stage with additional supply current demands. To reduce the additional current demand, resistance R12 would preferably be a high value, but this would occupy a large area on an integrated circuit, increasing the cost of the function, and the high resistance might also degrade the settling each cycle of the voltage on CCP and thus degrade the accuracy of the charge pump output voltage.

Embodiments of the present invention therefore provide biasing circuitry, e.g. for a MEMS transducer, that can be used to supply a bandgap reference voltage to the input of a switched DC-DC converter such as a charge pump 102 without requiring the use of a buffer, or other intermediate stage which requires a bias current, but which at least mitigates the problem of transients.

Figure 6:
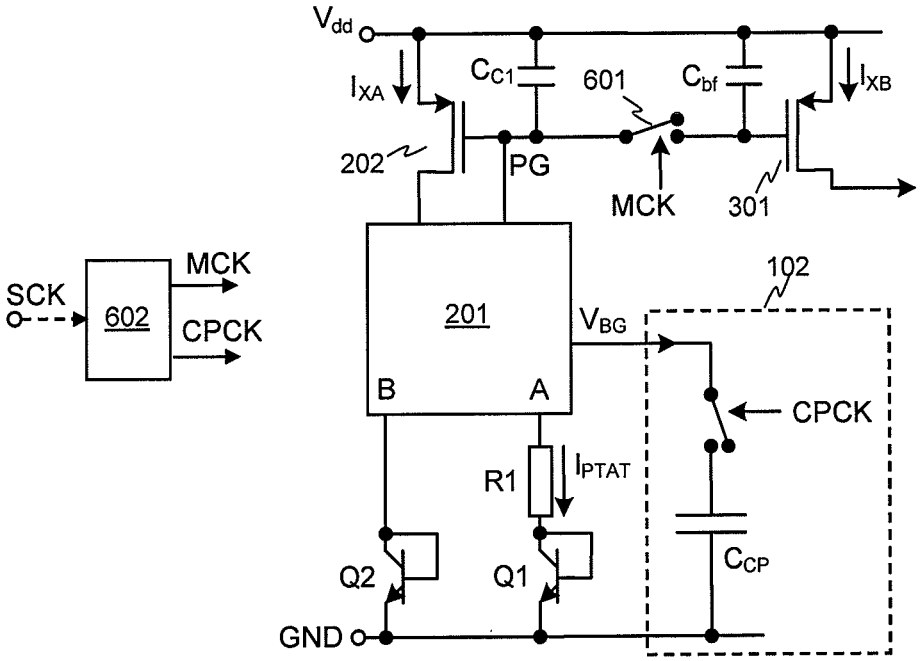
FIG. 6 illustrates biasing circuitry according to an embodiment of the present invention.

FIG. 6 illustrates one embodiment of the invention where similar components are identified by the same reference numerals as used previously. Again a bandgap reference voltage generator 105 is used for generating a bandgap voltage reference at a voltage output. As described previously control circuitry 201 controls a current source, i.e. controls the current through transistor 202 to equalize the voltages at nodes A and B and thus produces a supply independent current $I_{XA}$ and a supply independent and temperature stable voltage $V_{BG}$ is also produced as described previously. FIG. 6 illustrates the bandgap reference voltage $V_{BG}$ being used to directly provide the input to a DC-DC converter, which in this example is a charge pump 102 (again the charge pump circuitry is illustrated by model components, in this case only one switched capacitance, for simplicity). FIG. 6 also illustrates that a bias current source 301 may be arranged to mirror the supply independent current $I_{XA}$ and output a bias current $I_{XB}$.

In this embodiment a switch 601 is arranged in series with the control terminal of the bias current source 301, i.e. the gate terminal. This switch 601 is controlled, in use, so as to periodically be turned-off to isolate the gate control terminal of the bias current source, i.e. a bias control node, from the control circuitry of the bandgap reference voltage generator, i.e. from drive node PG, during a time window that corresponds to an expected voltage transient at the voltage output. The switch 601 is thus driven by a clock signal MCK so as to be opened, i.e. turned off, in time with the clocking of the charge pump 102. The switch 601 is opened at, or just before, the time that the charge pump 102 is operated to connect a partially depleted capacitance $C_{CP}$ to the reference bandgap voltage node. In this way the gate voltage of the transistor 301 is isolated from any transient that occurs on transistor 202. The switch 601 may be operated so as to be kept off/open for long enough such that the voltage/current transients have substantially reduced before the switch 601 is re-closed/turned back on. The switch 601 is thus off during a time window which includes the time at which the charge pump transitions from the first state to the second state. Note the switch 601 could be opened at the same time that the charge pump transitions and the relevant time window can thus begin at the time of transition and the term includes should be construed accordingly. Thus a control signal for the switch 601 could have a switching clock edge simultaneous with a clock edge for controlling the charge pump. It will of course by appreciated that the switch 601 will take a finite time to turn fully off. What is key is that the switch 601 has turned substantially off so as to isolate the current source before any significant transient occurs at the drive node PG.

In some embodiments the gate-source capacitance $C_{gs}$ of the transistor 301 may be sufficient so as to maintain the gate voltage substantially constant enough during the period that the switch 601 is open. In some embodiments however a capacitor $C_{bf}$ may be provided across the gate-source terminals of the transistor 301, i.e. between a voltage supply for the bias current source and the bias control node, e.g. the control terminal for the bias current source, to maintain the voltage of the control terminal of the bias current source at a desired level when the switch 601 is off. Such a capacitor $C_{bf}$ can help reduce any transients caused by operation of switch 601, for example as caused by parasitics such as channel charge or gate-drain overlap capacitance of a MOS switch. The capacitor $C_{bf}$ will also help prevent the gate drive being modulated by any transients from the amplifier present at the drain terminal of transistor 301 which could be coupled via the drain-gate capacitance during the period when the switch 601 is open. The capacitor $C_{bf}$ can be relatively small in value and thus does not require significant space. For example the capacitor $C_{bf}$ may have a value of around 0.2 pf or so.

The switch 601 and capacitor $C_{bf}$ can therefore be seen to act as a type of sample and hold circuit. The circuitry samples the value of the gate drive voltage developed by control circuitry 201 during a period when the voltage is substantially free of any transients and uses the held value, with transistor 301 isolated from the drive node PG, during a period when any voltage transients may be expected, for instance due to connecting a partially discharged capacitance $C_{CP}$ to node $V_{BG}$.

The switch 601 may comprise any suitable switching element or elements. For instance the switch 601 may be a single transistor switch such a PMOS for example, or possibly a transmission gate depending on the supply rail voltage, PMOS gate voltage and the threshold voltages of the PMOS or NMOS transistors available or used.

As mentioned previously the switch 601 may be controlled to be open for a period immediately following (and possibly just before) the charge pump 102 is switched from a first state to a second state to connect a capacitance $C_{CP}$, which may be partially discharged, to the reference voltage output node. The switching of the charge pump 102 is controlled by a charge pump control clock signal CPCK and thus the clock MCK used to control switch 601 may have a predetermined relationship to this charge pump control clock signal CPCK.

The clock MCK used to control switch 601 may be provided by clock generation circuitry 602. The clock generation circuitry 602 may also provide the charge pump control clock signal CPCK. In some embodiments the clock generation circuitry may be responsive to an externally supplied clock SCK, which may for example define the charge pump clock rate and from which the MCK signal could be derived. Additionally or alternatively the clock generation circuitry may include its own oscillator and may generate a clock signal internally, at least in some operating modes. In some embodiments the rate of the charge pump clock signal, and thus the MCK signal, may also be variable in use. One skilled in the art will be well aware of how to provide a first clock signal having a predetermined or programmable relationship to a second clock signal, either directly from an oscillator and/or using a received clock signal and various designs of clock generation circuitry 602 will be apparent to one skilled in the art.

As described above in some embodiments the reference voltage $V_{BG}$ may be supplied to a first capacitance $C_{CP}$ when the clock signal CPCK is high and to second capacitance $C_{CPB}$ when the clock signal CPCK is low. In this example therefore the switch 601 may be opened twice per clock period of the charge pump clock signal. Ideally the switch 601 will be closed after any transient on the node PG has dissipated.

For convenience of clock generation, the clock signal MCK for switch 601 may be twice the frequency of the charge pump clock signal CPCK, with a desired phase difference. However, in some embodiments a duty cycle of the order of 50% may mean that the voltage at node PG may not have completely settled by the time the clock signal MCK re-closes switch 601. This may lead to a small ripple in the gate voltage of transistor 301 and a consequent small ripple in the bias current $I_{XB}$. This ripple may be small and may be tolerable in some embodiments but in some cases it may be desirable to further reduce any such ripple.

In some embodiments therefore the start of each MCK pulse, i.e. the time at which the switch 601 is re-closed, may be delayed to give a duty cycle of the order of say 25% or 12.5%. The transistor or transistors comprising switch 601 are preferably small so as to reduce possible coupling of MCK onto node PG, and may thus offer significant resistance even when on, and this is exacerbated if the switch is only turned on for a small fraction of each cycle. But the voltage and charge on capacitor Cbf will not change rapidly during operation so the switch serves just to adjust the voltage for slow changes in environmental conditions such as temperature and compensate for any charge leakage. Thus the duty cycle is not limited by on resistance considerations. The duty cycle is more likely to be limited by inconvenience of generation of short duration MCK pulses, as well as the diminishing returns of the small relative extra settling time allowed before sampling.

Figure 7:
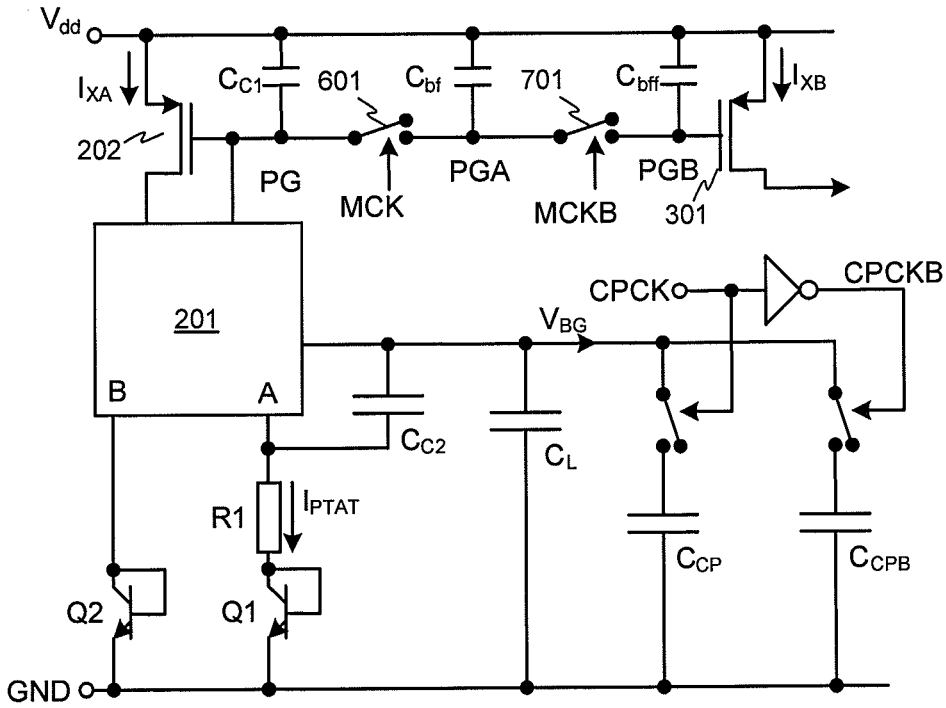
FIG. 7 illustrates another embodiment of biasing circuitry according to the present invention.

In some embodiments however it may be desirable to yet further reduce the sampled ripple. FIG. 7 illustrates a further embodiment of biasing circuitry according to another embodiment of the invention. In this embodiment there is at least one additional switch 701 in series between switch 601 and bias transistor 301 together with an associated additional capacitor $C_{bff}$ arranged so as to be in parallel with capacitor $C_{bf}$ when switch 701 is closed. This arrangement effectively provides a two stage sample-hold or switched capacitor filter between the node PG and a bias control node for the bias transistor 301.

Switches 601 and 701 may be switched in sequence by clock signals MCK and MCKB respectively. In one embodiment the clock signal MCKB may be substantially an inverted version of clock signal MCK so that switch 701 is closed when switch 601 is open and vice versa, i.e. the switches 601 and 701 are controlled in anti-phase. Switch 601 may be controlled as discussed previously to isolate node PGA, and consequently node PGB, which provides the gate drive for transistor 301 and thus is the bias control node, from drive node PG around the time that the charge pump 102 is controlled to switch the capacitance $C_{CP}/C_{CPB}$ to which the reference voltage $V_{BG}$ is connected. In this way both capacitors $C_{bf}$ and $C_{bff}$ are both isolated from node PG when any significant transient occurs. Thus switch 601 may be driven as discussed above in relation to FIG. 6. In this embodiment however when switch 601 is closed, switch 701 is open. Thus even if there is any residual voltage transient at node PG at the time that switch 601 is closed, i.e. turned back on, such ripple will not directly affect node PGB as switch 701 is open. The effect of any ripple will simply influence the overall voltage stored by capacitor $C_{bf}$. Switch 701 is closed when switch 601 is open so as to allow sampling of the resultant voltage stored on capacitor $C_{bf}$. In this way node PGB is isolated from any direct voltage ripple that occurs at node PG within each cycle.

This arrangement also isolates the gates of the bias chain, e.g. transistor 301 from the $I_{XA}$ transistor 202. In the circuit of FIG. 6, the dominant loop compensation is provided by capacitor $C_{c1}$, if present, and the gate capacitance of $I_{XA}$ transistor 202. However, when switch 601 is closed this capacitance is increased by capacitor $C_{bf}$ and the gate capacitance of bias transistor 301, altering the loop response and making it difficult to optimise for both conditions. In the circuit of FIG. 7, the additional capacitance seen at node PG when switch 601 is closed is only Cbf. This improvement is particularly significant in cases where there are multiple $I_{XB}$ bias transistors 301 in parallel to supply different circuit branches. Multiple bias transistors 301 driven in parallel with a common gate connection may be desirable in some embodiments to avoid the circuit area, supply current overhead and cumulative inaccuracy associated with multiple chained mirrors arranged to distribute bias currents.

Each of switches 601 and 701 may therefore have a duty cycle of around 50% and these two switches may be controlled to be substantially in anti-phase with one another (although in some embodiments a duty of cycle of just under 50% may be used to ensure a dead time between turning one switch, 601 or 701, off and the other switch on). It will be appreciated that other switching scenarios exist and in some embodiments it would be possible for both switches 601 and 701 to be on at the same time towards the end of a switching cycle when any transients will have settled.

In some embodiments there may be one or more bias transistors (not illustrated for simplicity) driven from node PGA in addition to one or more bias transistors 301 driven from node PGB. These transistors on node PGA will suffer larger transients than those on node PGB, but may supply enough capacitance to allow a reduction or removal of capacitance Cbf, thus possibly reducing chip size. These additional bias transistors may then for example be used to drive circuit elements less sensitive to the resulting bias current ripple.

The use of one or more switches to isolate the bias transistor 301 from the gate drive node of transistor 202, for at least certain periods of time (when voltage transients may be expected) thus allows the bandgap reference voltage generator circuit to be used to directly drive a switched DC-DC converter such as a charge pump whilst isolating any bias current that may be supplied to other circuit components, such as a signal amplifier.

In addition however it may be desirable to reduce the overall voltage transient and/or improve recovery in response to such transients.

In one embodiment therefore a capacitor $C_{C2}$ may be connected between the voltage output node $V_{BG}$ and node A of the bandgap bias circuitry as illustrated in FIG. 7, i.e. a control node of the control circuitry of the bandgap reference voltage generator. Capacitor $C_{C2}$ is provided so as to improve the transient response of the output reference voltage $V_{BG}$. This ensures that any transient at the output node $V_{BG}$ couples to node A (i.e. a control node of the differential transconductance stage) more quickly than is the case for an embodiment without such a capacitor. However the response of node B remains largely unchanged. The feedback loop therefore more quickly receives an error stimulus on node A and responds more quickly to restore the voltage on node A to equal that on node B, thus stabilising the output voltage $V_{BG}$ more quickly than otherwise would be the case. This ensures therefore that the voltage $V_{BG}$ stabilises more quickly and is back to the required level before the next switching half-cycle of the charge pump. This also reduces the overall period of a voltage ripple at node PG which would also be beneficial for minimising any ripple in the bias current as it is more likely that any transient will only occur during the period when switch 701 (or switch 601 in the FIG. 6 embodiment) is turned off/open, i.e. it is more likely that any transient will have died away by the time the switch is turned back on.

In some embodiments a load shunt capacitor $C_L$ may be connected to the voltage output $V_{BG}$ node, i.e. connected between the output node and ground (or more generally a common return terminal). Such a load shunt capacitor $C_L$ can help in supplying charge to the charge pump when required. For instance, at the instant when the partially discharged charge pump capacitance $C_{CP}$ is connected, the load shunt capacitor $C_L$ can provide much of the total required charge by simple charge sharing without pulling current from the bandgap output node. Thus, the voltage kick on node $V_{BG}$ and internal nodes of the reference circuitry may be much smaller than otherwise, so that any recovery is still essentially small-signal, rather than for instance leading to devices turning on and off or leaving their nominal regimes of operation, making any recovery better controlled. However, after this initial transient, both $C_{CP}$ and $C_L$ in parallel now require to be recharged the rest of the way up to the target voltage, so the remainder of the recovery transient may be slower.

It should be noted that were such a shunt capacitance $C_L$ to be used on its own (in the absence of capacitor $C_{C2}$ or switches 601/701) the capacitance $C_L$ would need to be relatively large to have any substantial impact, which would increase the size and cost of the circuitry. In many bandgap circuits, such as the circuit 105 illustrated in FIG. 3, the presence of a substantial capacitance at this output node $V_{BG}$ will introduce a second pole into the circuit. Thus would normally mean that the feedback loop would have to be slowed down with the capacitance $C_{C1}$ being increased accordingly. This would actually slow down the recovery from any transient that does occur which could result in the mean level of the voltage $V_{BG}$ being less well defined as the voltage never settles to an equilibrium level. For these reasons one skilled in the art would usually discount the use of such a shunt capacitance $C_L$.

However in embodiments of the present invention the presence of capacitor $C_{C2}$ increases the transient response as discussed above and also introduces a zero into the loop gain frequency response which helps to improve stability, and maintain stability even in the presence of a shunt load capacitance $C_L$.

Thus a shunt capacitance $C_L$ can be included to ensure that the bandgap circuit can fully support the current demands of the charge pump 102. The presence of a switched capacitor filter arrangement separating the bias transistor from current source 202 and/or the presence of capacitor $C_{C2}$ enables the shunt capacitance $C_L$ to be smaller than would otherwise be required, thus reducing the size and cost implications of including such a capacitance, and the increased design freedom and loop stability overcome the problems that would normally be associated with a capacitance at this node $V_{BG}$.

The use of a capacitance $C_{C2}$ connected between the voltage output node VBG and node A, i.e. a feedback node of the bandgap reference control circuit, to allow use of a load shunt capacitance $C_L$ represents another aspect of the invention.

Figure 8:
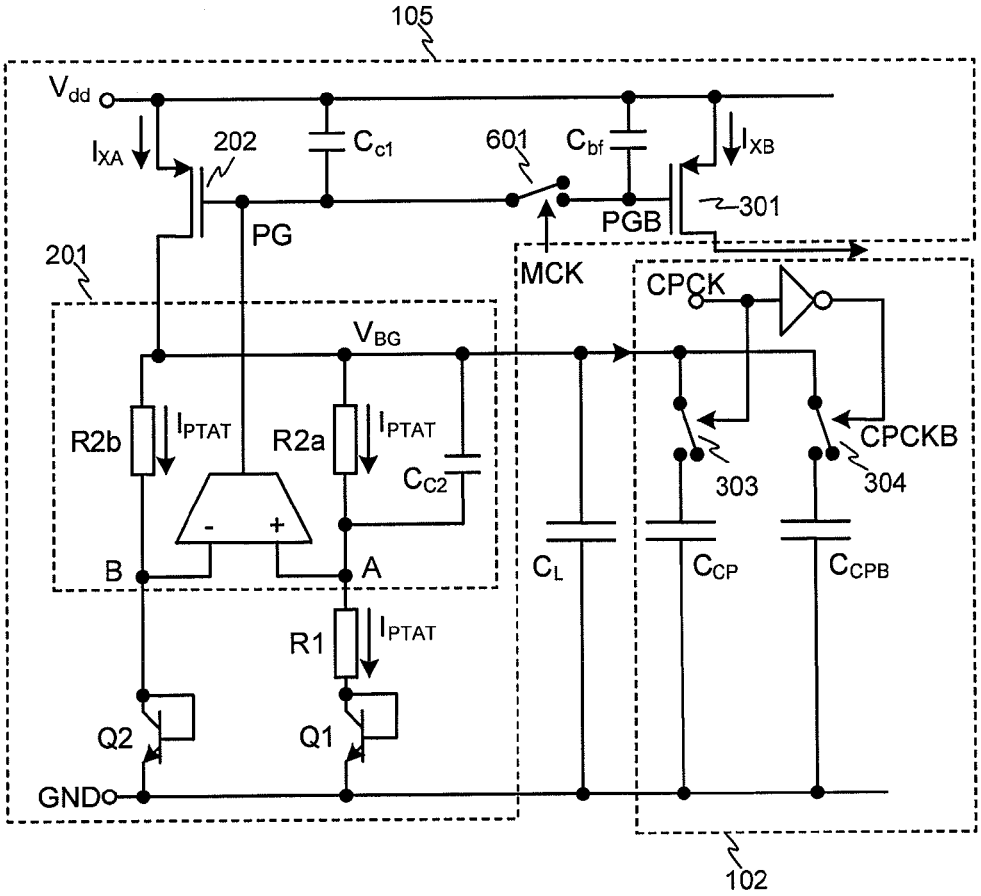
FIG. 8 illustrates a further embodiment of biasing circuitry according to embodiments of the present invention.

FIG. 8 illustrates an embodiment of a biasing circuit in more detail. As described above in relation to FIG. 3 the bandgap reference generator control circuitry 201 comprises a differential input transconductance stage, e.g. a differential long-tailed pair, which controls the gate voltage V(PG) and hence the drain current $I_{X4}$ of PMOS transistor 202. In this embodiment the output voltage $V_{BG}$ of the bandgap biasing circuitry 105 is connected directly to the input of the charge pump 102 but a shunt capacitance $C_L$ is connected in parallel between the input to the charge pump and ground reference (or some other suitable reference). To provide stability and a faster transient response a capacitance $C_{C2}$ is connected between the voltage output $V_{BG}$ node of the biasing circuitry 105 and an input to the transconductance stage 201.

The value of capacitance $C_{C2}$ is generally optimised, e.g. by simulation, to provide the best time-domain settling response given the value of the shunt load capacitance $C_L$, if present. In one example the shunt load capacitance $C_L$ was of the order of about 26 pf and the value of capacitor $C_{C2}$ was chosen to be around 10 pf. In such an example the capacitor $C_{C1}$ may have a value of around 2 pf and the supply independent current $I_{X4}$ may be of the order of 15 μA or so. This ensures that the biasing circuitry 105 can supply the necessary charging current required by the charge pump 102 but has good loop stability and the voltage output $V_{BG}$ settles Also to isolate bias current transistor(s) 301 from transients at drive node PG switch 601 is provided and controlled in accordance with the timing of the switching of the charge pump 102. The gate voltage $V_G$ of bias transistor 301 is held constant during periods when switch 601 is open by capacitor $C_{bf}$, which as mentioned above may have a value of the order of 0.2 pf or so. In some embodiments however, larger values of capacitance may be used for various reasons. For instance it may be desired to reduce capacitive coupling of signals from the gate drive of the switches or from local interconnect. Also for example in the circuit of FIG. 7, the thermal noise of the switch 601 will introduce an uncertainty in the voltage to which $C_{bf}$ is recharged each cycle. This will introduce wideband kT/C noise (as well known in the field of switched-capacitor filters) which may be re-sampled by switch 701 to produce aliased-down noise components at lower frequencies in the voltage on node bias control node PGB and consequently noise current components in $I_{XB}$.

Figure 9:
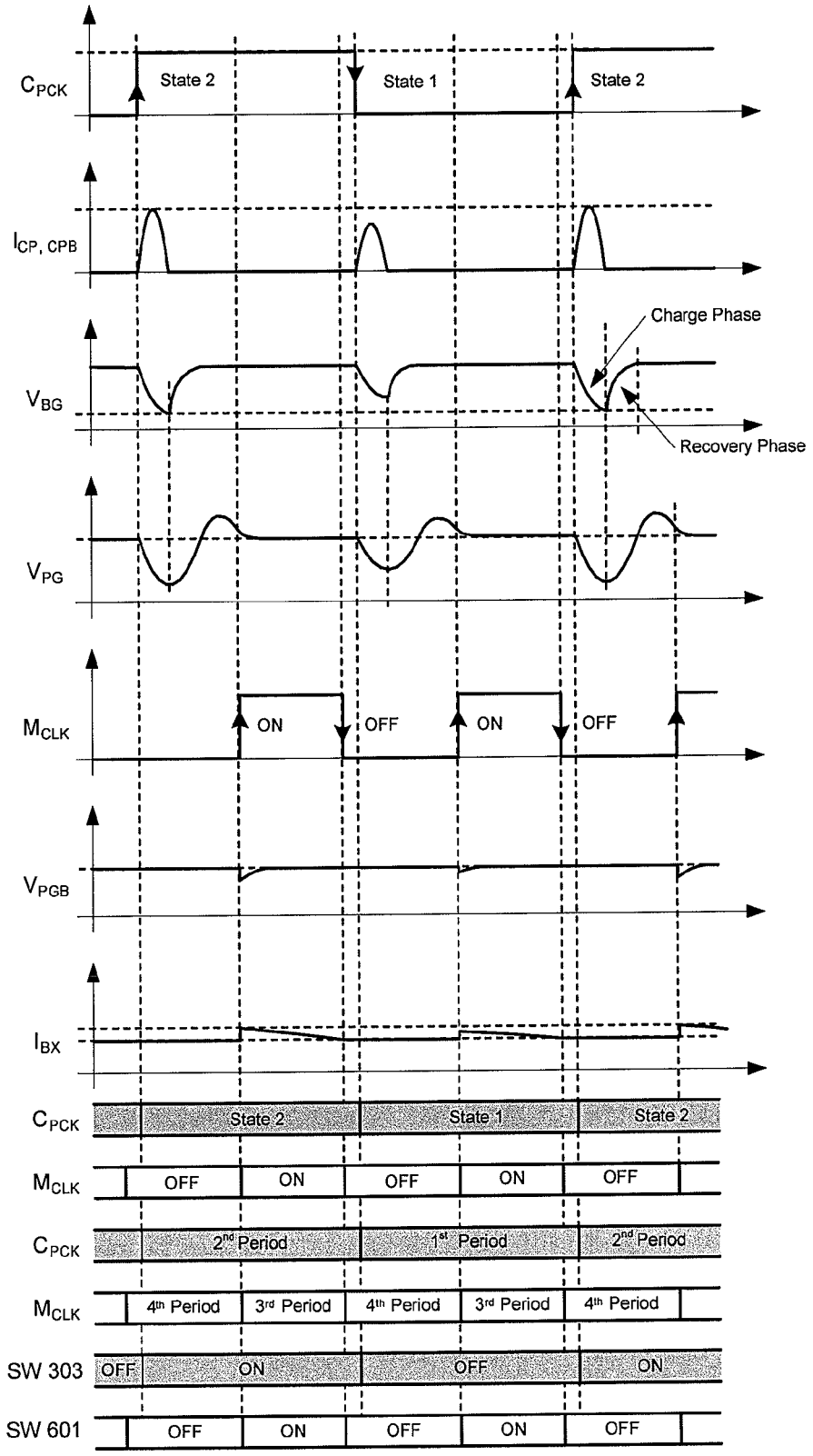
FIG. 9 illustrates example waveforms experienced in the operation of a circuit such as that illustrated in FIG. 8.

FIG. 9 illustrates example waveforms that would be expected in use of the circuit illustrated in FIG. 8. As described above at each rising edge and falling edge of the charge pump clock signal CPCK there is a current pulse at the input to the charge pump which is due to charging of the relevant charge pump capacitances (and depending on the structure of the charge pump the relevant current pulse at a rising edge of the CPCK clock signal may have a different magnitude to that at a falling edge of the CPCK clock signal as illustrated). This will again lead to a dip in the output reference voltage $V_{BG}$ and a corresponding modulation of the voltage at node PG. It should be noted that the overall magnitude of the dip in output voltage experienced in the circuit of FIG. 8 may be slightly less than the circuit shown in FIG. 3 (i.e. illustrated in the waveforms of FIG. 4). However in the embodiment illustrated in FIG. 8 the voltage transient decays much more quickly that for the circuit of FIG. 3. Through appropriate choice of capacitor $C_{C2}$ (and shunt load capacitor $C_L$), the voltage output $V_{BG}$ settles quickly and thus is almost flat for the second half of the cycle, despite limited gain-bandwidth.

In this embodiment, the charge pump capacitance $C_{CP}$ is disconnected during a first state and partially discharges and is connected to be recharged in a second state and charge pump capacitance $C_{CPB}$ is connected to be recharged during the first state and partially discharges in the second state. In this embodiment therefore the switch 601 is controlled to be open during a time window that includes a transition from the first state to the second state and also during another time window that includes a transition from the second state to the first state. Thus the switching clock signal MCK controlling switch 601 is twice the frequency of the charge pump clock signal CPCK and slightly offset in phase so that the gate node of the bias transistor is isolated from node PG during the main period of the transient. The voltage at node PGB is held at a constant level when the switch 601 is open during this period. In this example, with a single switch 601 with a 50% duty cycle, the voltage at node PG has not fully settled back to its quiescent level when the switch 601 is re-closed/turned-on and thus there is a slight voltage modulation of the gate voltage of bias transistor 301 and hence in the bias current output $I_{BX}$. However it can be seen that this modulation is much less than in the waveforms illustrated in FIG. 4.

It can therefore be seen that the charge pump control clock signal CPCK defines the times at which the charge pump changes from the first state to the second state and vice versa. Considering just capacitance $C_{CP}$ for a moment the charge pump control clock signal CPCK defines a repeating cycle of a first period when switch 303 is open (off) and the capacitance CCP is disconnected from the voltage input and a second period when switch 303 is closed (on) and the capacitance $C_{CP}$ is connected to be recharged. The clock signal MCK applied to control switch 601 defines a repeating cycle of a third period when the switch 601 is on (closed) and a fourth period when the switch 601 is off (open).

The timing is arranged so that the transition from the first charge pump state to the second charge pump state, i.e. the end of a first period and the start of a second period, occurs during the fourth period, when switch 601 is off. Thus switch 303 is turned on to connect the capacitance $C_{CP}$ to be recharged during the fourth period when switch 601 is off. In this embodiment the timing is also arranged so that the transition from the second charge pump state to the first charge pump state, i.e. the end of a second period and the start of a first period, also occurs during the fourth period, when switch 601 is off. In this embodiment the transition from the second charge pump state to the first charge pump state involves turning switch 304 on to reconnect capacitance $C_{CPB}$ to be recharged. Thus each third period, when the switch 601 is on, occurs wholly within a first period or a second period but does not overlap with both a first period and a second period.

It will be appreciated however that the timing could be different were the charge pump configured so that the switching cycle comprises a second state for a second period where a capacitance $C_{CP}$ is connected to be recharged but also a first state for a first period where the input voltage was disconnected from the capacitance $C_{CP}$ without being connected to another partial discharged capacitance or any other component likely to result in significant current flow. In such a case the transition from the first state to the second state should still occur within the fourth period when switch 601 is off but in this case it may not be necessary for the third period to exclude the transition from the second state to the first state.

It should be noted that since the bias gate drive $V_{PGB}$ is sample-held in the embodiment of FIG. 8, any wideband thermal noise on the bias drive line would be aliased down, potentially adding to audio-band bias noise. However as described above typically the sampling frequency, f(MCK), will be twice the switching frequency of the charge pump clock signal CPCK. Thus a typically sampling frequency for the gate drive of the bias transistor 301 may be of the order of 1 MHz or so. A loop bandwidth of 500 kHz allows 1.8 time constants settling at 0.5 μs.

Figure 10:
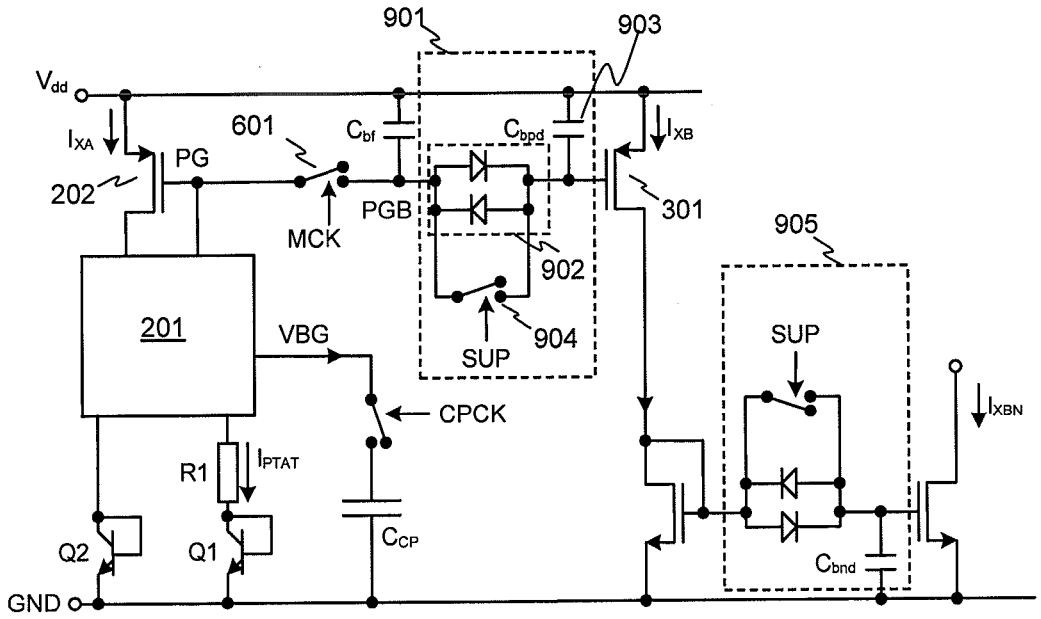
FIG. 10 illustrates a further embodiment of biasing circuitry according to embodiments of the present invention having a filter.

In some embodiments a filter may be provided to filter the voltage at the gate of bias transistor 301, i.e. a filter may be provided between the bias control node PGB and the bias control terminal (i.e. the gate) of transistor 301. FIG. 10 illustrates a further embodiment wherein a filter 901 is provided between switch 601 and the gate node of bias transistor 301 to filter the voltage on capacitor $C_{bf}$ at the bias control node. In this example an RC type filter arrangement is implemented using a resistance 902 and capacitor $C_{bpd}$ 903. The resistance 902 may, for example be implemented by a diode such as a polysilicon diode element. As mentioned above polysilicon diodes are known for use as high impedance elements in biasing circuits for MEMS transducers and thus conventional circuit designs may already include polysilicon diode elements. In the example illustrated in FIG. 10 the filter 901 comprises a pair of anti-parallel poly diodes.

This arrangement filters not only any switching spikes such as discussed above, but also the thermal (and flicker) noise of the input preceding circuitry. The time constant of the filter 901 may be of the same order as that of this input node—i.e. sub-audio.

The high impedance offered by polysilicon diodes enables the capacitor $C_{bpd}$ to be relatively small, say of similar order to the 1 pf capacitance of the MEMS transducer. Series and/or parallel combinations of diodes may be used to define an appropriate time constant. In some applications a single diode might suffice, but a pair of anti-parallel diodes will give a symmetric characteristic and thus help avoid any diode "pumping" of the voltage due to the transients caused due to switching of the charge-pump or cross-talk from elsewhere on the integrated circuit.

In some embodiments a by-pass switch 904 may be provided to provide a bypass path for bypassing the filter, e.g. avoiding the resistance element. The bypass switch may activated on start-up or other reset conditions to speed up initial settling.

FIG. 10 illustrates an embodiment with a single switch stage in the path between drive node PG and the bias control node PGB. It will of course be appreciated that a filter could also be used in an embodiment with multiple switch stages, such as discussed above in relation to FIG. 7, with the filter being provided between the final switch stage, e.g. 701, and the bias transistor or between two switch stages, e.g. between switches 601 and 701.

At least one filter 905 may be provided downstream at any current mirrors required to duplicate or invert the bias current. Such a filter 905 may be similar to filter 901 described above and may be provided in addition to or instead of filter 901.

In general, to ensure quick enough settling of the voltage at node PG, i.e. within a clock period (or half period) of the charge pump clock signal, while also keeping current consumption low, the gate capacitance of transistor 202 may need to be constrained to be quite low, i.e. the width and length of the gate may be small. However the gate-referred flicker noise voltage of an MOS transistor is inversely proportional to the square root of the gate area. Thus keeping the gate area of transistor 202 low can result in flicker noise. The noise in the output bias current due to the flicker noise of transistor 202 (and other devices) may be reduced by use of a filter such as described above in relation to FIG. 10. However that of bias transistor 301, which is usually matched to transistor 202, or at least a small multiple of it, will still be unfiltered.

In some embodiments the effect of flicker noise in the bias current $I_{XB}$ can be reduced by chopping the bias current between at least two different transistors which may for instance be transistors 202 and 301.

Figure 11:
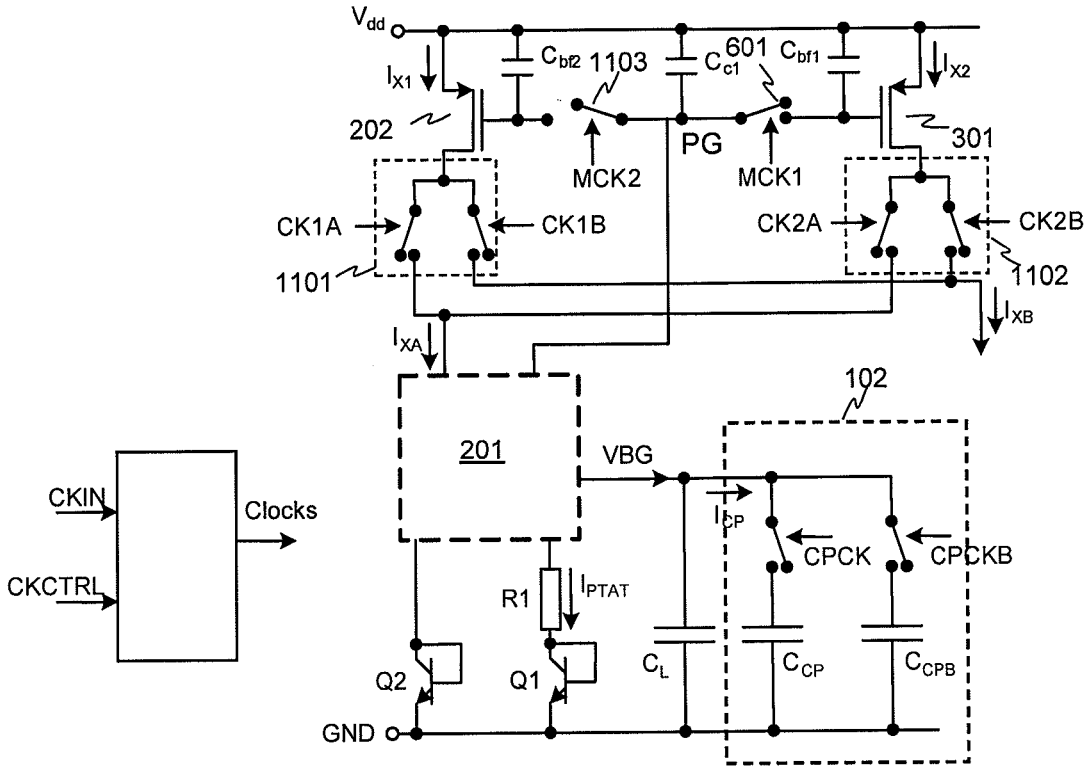
FIG. 11 illustrates a further embodiment of biasing circuitry according to embodiments of the present invention where the bias current is provided by a chopper arrangement.

FIG. 11 illustrates one embodiment in which the drain of transistor 202 is connected to a chopper switch circuit 1101 which can selectively pass the drain current to the control circuitry 201 or to the bias current output. Likewise the drain of transistor 301 is connected to chopper switch circuit 1102 which also can selectively pass the drain current to the control circuitry 201 or to the bias current output. The chopper switch circuit 1101 is driven by clock signals CK1A and CK1B and the chopper switch circuit 1102 is driven by clock signals CK2A and CK2B. In addition, as well as first switch 601 between node PG and transistor 301 and capacitor $C_{bf1}$ there is a second switch 1103 between node PG and transistor 202 and an additional bias control capacitor $C_{bf2}$. First switch 601 is driven by a clock signal MCK1 and second switch 1103 by a clock signal MCK2.

Consider first the action of the chopper clocks CK1A, CK2B, CK2A and CK2B. Clock signal CK1A is the same as clock signal CK2B. Clock signal CK1B is the same as CK2A and these are the inverse of clock signal CK1A (or equivalently CK2B). The clock signals are arranged such that each of the current sources, i.e. transistors 202 and 301, alternate between supplying current to the control circuitry or to the bias current output node. In a first chopper state (State A: CK1A high) transistor 202 supplies current $I_{XA}$ into the reference control circuitry and transistor 301 supplies bias current $I_{XB}$ out of the bias current output node. In this state A the circuit functions as described in the embodiments above. In a second chopper state (State B: CK1A low) transistor 202 provides the bias current $I_{XB}$ and transistor 301 provides $I_{XA}$. Table 1 below summarises these states.

TABLE 1

| | State A | State B |
|---|---|---|
| CK1A | High | Low |
| CK1B | Low | High |
| CK2A | Low | High |
| CK2B | High | Low |
| I(202) | $I_{XA}$ | $I_{XB}$ |
| I(301) | $I_{XB}$ | $I_{XA}$ |

Ignoring for now the action of switches 601 and 1103, i.e. assuming they are both permanently on or replaced by short-circuits, the effect of the chopper action is to reduce the flicker noise in the resulting bias current. The flicker noise of the two transistors 301, 202, may be represented as low-frequency current sources, say Inf1 and Inf2, from the source to drain of each transistor. Assuming a 50:50 duty cycle (in terms of each transistor providing the currents $I_{XA}$ and $I_{XB}$), and considering noise frequencies below the switching frequency, then half the time Inf1 will be a component of the current $I_{XA}$ supplied to the control circuit and the other half of the time will be a component of the current $I_{XB}$ which is output from the output node. The same will hold true for noise source Inf2 associated with the other transistor. Averaged over several clock cycles, $I_{XB}$ will equal $I_{XA}$ and assuming both Inf1 and Inf2 are zero-mean, then the average $I_{XB}$ (and average $I_{XA}$) will be the same value as if there was no flicker noise. Also any manufacturing mismatch between the characteristics of the two transistors 202 and 301 will be similarly nulled, helping the accuracy of the output current, and thus reducing any extra nominal current consumption of downstream circuitry biased therefrom arising from allowing extra design margin for inaccuracy.

The chopper clock frequency may be the same as the charge pump clock frequency for convenience, or may be some convenient ratio as illustrated in an example below. However in the absence of switches 601 and 1103, the circuit would suffer the same issues relating to load transients arising from cyclic reconnection of the charge pump load causing modulation of the output bias current $I_{XB}$. To avoid this effect, some embodiments of the invention comprise switches 601 and 1103, with associated clocks MCLK1 and MCLK2 supplied thereto. The clock MCK1 is arranged so that when transistor 301 is providing the bias current output $I_{XB}$ the first switch 601 is open (turned off) at the time of any expected transient on node PG due to switching of the charge pump as described above. Likewise the clock MCK2 is also arranged so that when transistor 202 is providing the bias current output $I_{XB}$ the second switch 1103 is open (turned off) at the time of any expected transient. Each switch is later closed (turned back on) when the respective transient is expected to have died away. This may occur while the respective transistor 301 or 202 is still supplying the bias current output $I_{XB}$. In some embodiments it may not occur until at or just before the time when the respective transistor is due to start supplying the feedback current $I_{XA}$ to the reference control circuitry.

Thus in summary the charge pump clocks CPCK and CPCKB define two states (State 1 and State 2 say) of the charge pump corresponding to connecting and disconnecting various charge pump input capacitances, the chopper clocks CK1A, CK2B, CK2A, CK2B define two states (State A and State B) of the chopped current mirror, and the clocks MCK1 and MCK2 are used to disconnect whichever bias transistor (as controlled by the chopper clocks) is currently supplying the bias current output from the expected transient on the other bias transistor currently in the reference control feedback loop during and after the reconnection of a charge pump capacitance by the charge pump clocks.

Figure 12A:
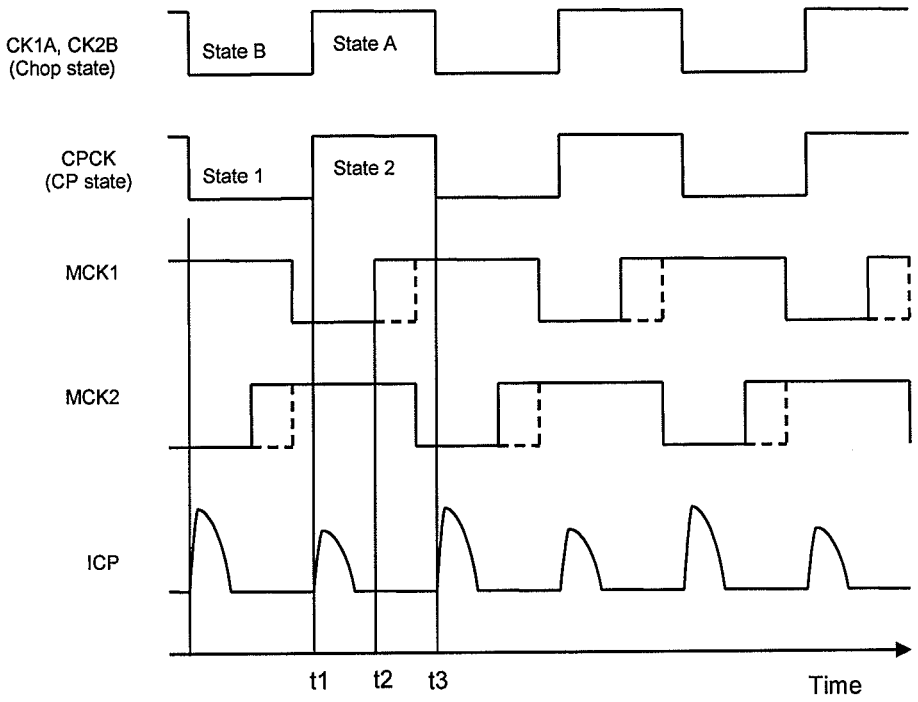
FIGS. 12*a* and 12*b* illustrate example clocking waveforms for the embodiment shown in FIG. 11.

FIG. 12*a* shows the clocking waveforms in one embodiment where the charge pump control clock signal CPCK has the same form as chopper clocks CK1A and CK2B. The clock signals CPCKB, CK1B and CK2A would be the inverse of CPCK. Thus the charge pump State 1 coincides with chopper state B and charge pump State 2 coincides with charge pump state 1.

At time t1, CPCK goes high and charge pump capacitance $C_{CP}$ is reconnected, giving a transient in load current ICP. At the same time chopper clocks CK1A and CK2B both go high so that transistor 202 provides current $I_{XA}$ whilst transistor 301 provides the bias current $I_{XB}$. At this time, MCK2 is high to allow so transistor 202 to be connected in a feedback loop comprising the reference control circuitry and the drive node PG. Drive node PG will be subject to a transient, but will settle out before the end of the clock phase with a refreshed bias voltage. MCK1 is arranged to go low just prior to t1, to isolate the gate of transistor 301 from the voltage transient on PG. MCK1 stays low until time t2 at which time the transient is expected to have decayed. At the end of the clock phase, at time t3, CPCK, CPCKB and the chopper clocks transition to the opposite state, and the bias transistors 202, 301 swap roles and it is MCK2 that must be low at this transition.

In this embodiment (as illustrated by the continuous lines of the chopper clock signals) clock MCK1 goes high half way through the clock phase, so during the latter half of the duration of State A the gate of the transistor 301 supplying the bias current $I_{XB}$ is connected to the drive node PG to refresh the voltage on the gate of transistor 301. In other embodiments however (for example as illustrated by the dashed lines) the chopper clock MCK1 may stay low until almost the end of the clock phase: the gate voltage of transistor 301 will be refreshed during the next clock phase, during which it is connected to PG in the feedback loop. The chopper clock MCK2 may behave in the same way as clock MCK1 and may be equivalent to a phase shifted version of MCK1.

Figure 12B:
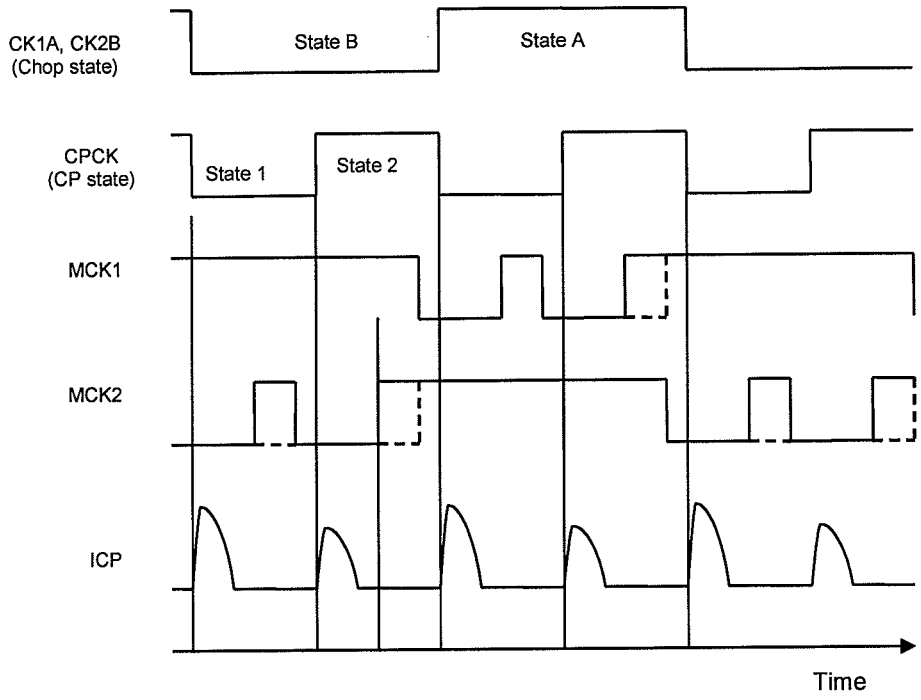

FIG. 12*b* illustrates the clocking waveforms in another embodiment where the frequency of the charge pump control clock signal CPCK is an integer multiple of the frequency of clocks CK1A, CK2B, CK2A and CK2B, in this example double. In this example both charge pump states State 1 and State 2 occur during each chopper state (State A, State B). During chopper state B, it is MCK1 which must be low at each transition of CPCK; during chopper state A it is MCK2 which must be low at each transition of CPCK. MCK1 (or MCK2) may go high during a later part, say half way through, each phase of CPCK, as illustrated by the continuous lines, to refresh the gate voltage of the transistor currently sourcing IXB, or it may only go high just before the transition of chopper state when the opposite clock MCK2 (or MCK1) goes low, in order to gain control of the feedback loop just before the load transient.

Variations in clocking schemes that could be applied will be apparent to one skilled in the art and may be adapted for a particular application. For example, there may be some small overlap or underlap between nominally synchronous clock edges.

The discussion above has focussed on bandgap reference generation circuitry for providing an accurate, temperature-insensitive reference voltage. In some applications, however, it may be desirable to provide a voltage with a non-zero temperature coefficient, i.e. a voltage that varies with temperature in some predictable way. For example a temperature dependent voltage could be useful to compensate for a sensitivity variation with temperature of the transducer, for instance the temperature sensitivity of the membrane of a transducer having a flexible membrane. For some designs of MEMS transducer a temperature sensitivity of up to about −3500 ppm/deg C. have been observed.

The temperature co-efficient of the reference voltage can be controlled by appropriately setting the resistor ratio of the reference generation circuit (this may require compensating for the different value of reference voltage by altering the gain of the charge pump).

If a non-zero temperature co-efficient is permitted there are other, non-bandgap, circuits for generating a reference voltage that may offer the advantages of being relatively simpler circuits and possibly lower noise, albeit generally less accurate.

Figure 13:
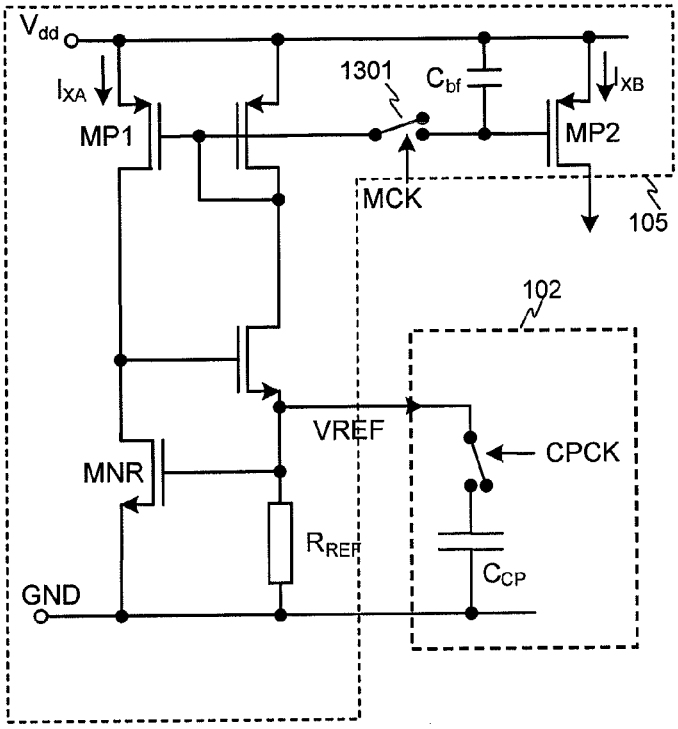
FIG. 13 illustrates an alternative reference voltage generator circuit.

FIG. 13 illustrates an alternative reference generator circuit 105. This circuit generates a reference voltage Vref approximately equal to the threshold voltage of a MOS transistor MNR together with a bias current $I_{XA}$ equal to $VREF/R_{REF}$. This would be useful for compensating for a transducer with a temperature co-efficient of the order of +3000 ppm or so. The voltage reference Vref can be output directly to the input of a charge pump circuit 102 as described above. A current mirror comprising transistor MP2 can be arranged to provide a current $I_{XB}$ proportional to $I_{XA}$. A switch 1301, clocked by a clock signal MCK, and capacitor $C_{bf}$ is arranged as described above to provide a sample-and-hold type arrangement to isolate transistor MP2 at times when the charge pump changes to state to connect a partially depleted capacitance to be recharged, resulting in current loading on the voltage output of the reference circuit. This provides the same advantages as described above. Other standard bias voltage/current sources may be adapted similarly to provide a reference voltage directly to a charge pump circuit and also a bias current, with at least one switch and capacitor being arranged to isolate a transistor that provides the bias current from transients associated with changing switch state of the charge pump circuit.

Figure 1:
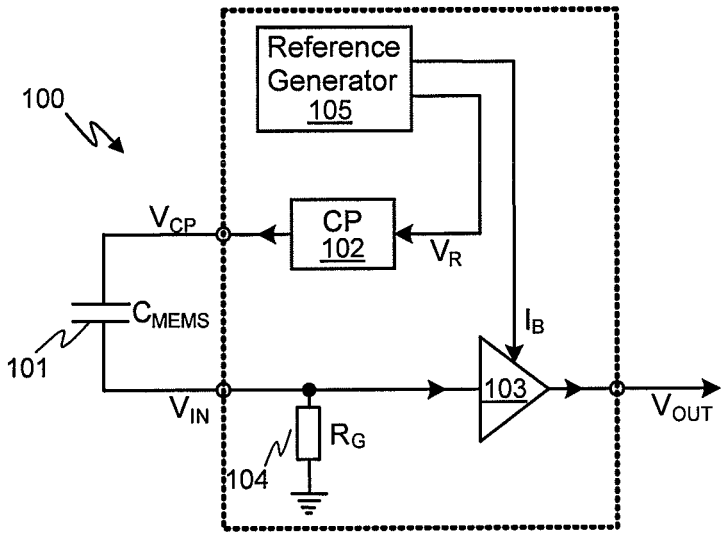
FIG. 1 illustrates a conventional pre-amplifier circuit for a MEMS transducer.

In the circuit of FIG. 1, one terminal of the MEMS transducer is coupled to the charge pump output and the other terminal is grounded via a bias resistance $R_G$ 104 and input to the amplifier 103. The invention is applicable to other input configurations. For example In some embodiments, one terminal of the MEMS transducer may be grounded while the other terminal is coupled to the charge pump 102 via bias resistance $R_G$ 104 and coupled to the input of the amplifier 103, possibly via an a.c. coupling capacitance.

The invention is also applicable to various types of amplifier 103. Amplifier 103 may be a simple source follower as described, or a more complex amplifier stage, such as a super source follower, and may be designed to operate in Class A or Class AB for instance.

In general therefore embodiments of the present invention allow a reference voltage generator circuit to be used to directly drive a switched DC-DC converter such as a charge pump whilst isolating any current that may be supplied to other circuit components, such as a signal amplifier and/or providing a better recovery from voltage transients associated with charging the DC-DC converter.

Figure 14:
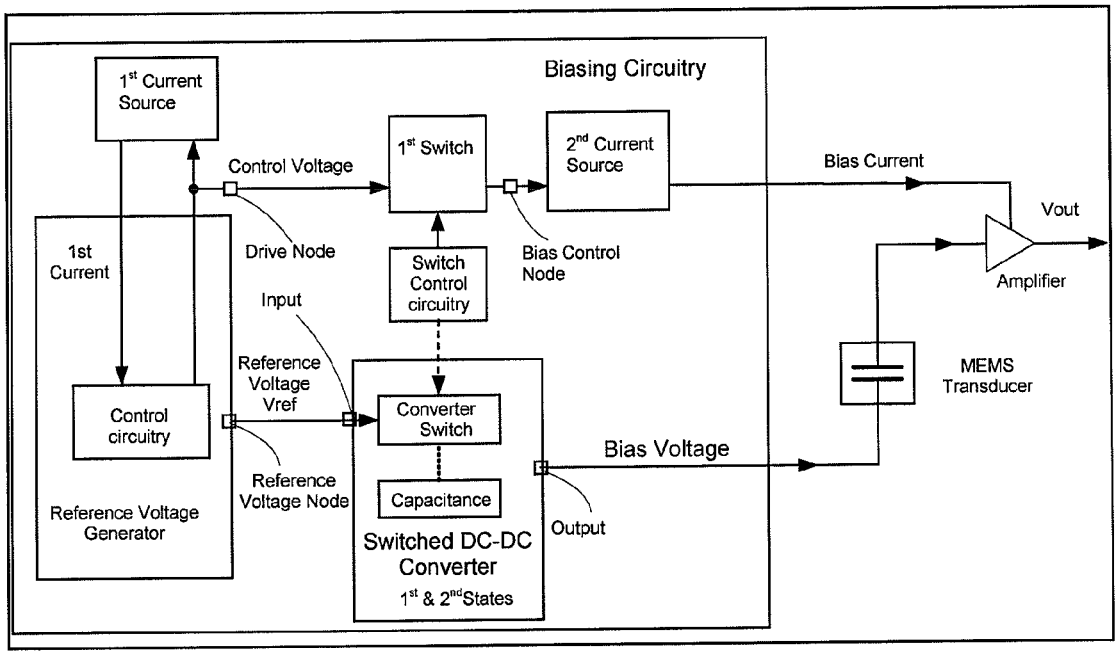
FIG. 14 illustrates a further embodiment.

FIG. 14 illustrates an embodiment in general terms and shows biasing circuitry for supplying a bias voltage to a MEMS transducer and also a bias current to signal processing circuitry associated with the transducer, such as an amplifier. The biasing circuitry has a reference voltage generator for generating a reference voltage at a reference voltage node. The reference voltage node is connected to an input of a switched DC-DC converter, such as a charge pump. The DC-DC converter is operable in at least first and second states where a converter capacitance can be selectively connected to or disconnected from the input and thus also the reference voltage node. The switched DC-DC converter comprises at least one converter switch and the converter capacitance is thus coupled to the reference voltage node via the converter switch. In use the DC-DC converter produces a bias voltage at an output for biasing the MEMS transducer.

The reference voltage generator has control circuitry for generating a control voltage at a drive node. A first current source is operable to supply a first current to the reference voltage generator, where the first current may be controlled by the voltage at the drive node. A second current source is operable to generate a bias current for biasing signal processing circuitry associated with the MEMS transducer, such as an amplifier. The second current source is controlled by a voltage at a bias control node. The bias control node is connected to the drive node by a first switch. Switch control circuitry controls the first switch, and optionally the converter switch of the DC-DC converter to cyclically open and close the first switch such that the first switch is open (and the drive node and bias control node are disconnected) during a time window that includes the time at which the switched DC-DC converter switches from the first state to the second state, or, in other words, the time at which the converter switch operates to connect the converter capacitance to the input (and thus the reference voltage node) to start recharging the converter capacitance.

Embodiments of the present invention are particularly applicable to biasing circuitry and methods for MEMS transducers, especially MEMS capacitive transducers such MEMS microphones. However the principles of the invention may be applied for biasing other apparatus such as other capacitive sensor. Embodiments of the invention may be arranged as part of an audio and/or signal processing circuit, for instance an audio circuit which may be provided in a host device. Embodiments of the invention also relate to MEMS or similar capacitive ultrasonic transducer circuits. A circuit according to an embodiment of the present invention may be implemented as an integrated circuit. A MEMS transducer may form part of the integrated circuit on a monolithic substrate or be connected to the integrated circuit in use.

Embodiments may be implemented in a host device, especially a portable and/or battery powered host device such as a mobile telephone, an audio player, a video player, a PDA, a mobile computing platform such as a laptop computer or tablet and/or a games device for example.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

What is claimed is:

1. Biasing circuitry for biasing a MEMS transducer and associated signal processing circuitry, comprising:

a reference voltage generator for generating a reference voltage at a reference voltage node, said reference voltage generator comprising control circuitry for generating a first drive signal at a drive node;

a first current source, the first current source being operable to supply a first current to the reference voltage generator in response to said first drive signal at said drive node;

a switched DC-DC converter having a voltage input connected to said reference voltage node and a voltage output for providing a bias voltage for said MEMS transducer, said DC-DC converter being operable in use to cyclically switch in a sequence of states including at least a first state where a first converter capacitance is disconnected from the said voltage input followed by a second state where said first converter capacitance is connected to said voltage input;

a second current source, the second current source being operable to supply a bias current to a bias current output in response to a voltage at a bias control node;

a first switch connected between said drive node and said bias control node; and switch control circuitry configured to control said first switch in use when said second current source is providing said bias current to cyclically open and close said first switch such that the first switch is open during a time window that includes the time at which the switched DC-DC converter switches from the first state to the second state.

2. Biasing circuitry as claimed in claim 1 comprising a first bias control capacitor connected to the bias control node so as to maintain the voltage of the bias control node when the first switch is open.

3. Biasing circuitry as claimed in claim 2 wherein said first bias control capacitor is connected between a voltage supply for the second current source.

4. Biasing circuitry as claimed in claim 1 wherein the switch control circuitry is configured to provide a first clock signal for controlling said first switch.

5. Biasing circuitry as claimed in claim 4 wherein the first clock signal has a predetermined relationship to a control clock signal for the switched DC-DC converter.

6. Biasing circuitry as claimed in claim 5 wherein the first clock signal is twice the frequency of the control clock signal.

7. Biasing circuitry as claimed in claim 5 wherein there is a predetermined phase difference between the first clock signal and the control clock signal such that each rising edge and/or each falling edge of the control clock signal occurs during a period when the first switch is open.

8. Biasing circuitry as claimed in claim 5 wherein said switch control circuitry is configured to provide said control clock signal.

9. Biasing circuitry as claimed in claim 8 wherein said switch control circuitry has an input for receiving an externally generated clock signal and is configured to generate said first clock signal and said control clock signal from said externally generated clock signal.

10. Biasing circuitry as claimed in claim 1 further comprising a second switch in series between the first switch and the bias control node.

11. Biasing circuitry as claimed in claim 10 wherein the second switch is controlled in anti-phase with the first switch.

12. Biasing circuitry as claimed in claim 10 comprising a first bias control capacitor connected between a voltage supply for the second current source and the bias control node and a second bias control capacitor connected between the voltage supply for the second current source and a node which is between the first and second switches.

13. Biasing circuitry as claimed in claim 1 wherein the bias current source comprises a transistor.

14. Biasing circuitry as claimed in claim 1 further comprising a feedback capacitor connected between the voltage output and a control node of the control circuitry of the reference voltage generator.

15. Biasing circuitry as claimed in claim 14 wherein said control circuitry comprises a differential transconductance stage and said control node is an input to the differential transconductance stage.

16. Biasing circuitry as claimed in claim 1 further comprising a shunt load capacitor connected between the voltage output of the reference voltage generator and a common voltage terminal.

17. Biasing circuitry as claimed in claim 1 wherein said DC-DC converter is also operable to switch from a third state in which the voltage input is disconnected from a second converter capacitance to a fourth state where said second converter capacitance is connected to the voltage input and wherein said switch control circuitry is configured to control said first switch in use such that the first switch is open during a time window that includes the time at which the switched DC-DC converter switches from the third state to the fourth state.

18. Biasing circuitry as claimed in claim 17 wherein said fourth state is the same state as said first state.

19. Biasing circuitry as claimed in claim 17 wherein said second state is the same state as said third state.

20. Biasing circuitry as claimed in claim 1 comprising a filter connected between said first switch and said second current source.

21. Biasing circuitry as claimed in 20 wherein said filter is connected between said bias control node and said second current source.

22. Biasing circuitry as claimed in claim 20 wherein said filter comprises at least one polysilicon diode and at least one capacitor.

23. Biasing circuitry as claimed in claim 22 wherein said filter comprises two polysilicon diodes connected to be antiparallel to one another.

24. Biasing circuitry as claimed in claim 20 comprising a bypass switch connected in parallel with said filter for bypassing the filter.

25. Biasing circuitry as claimed in claim 1 wherein said first current source is further operable to supply a bias current to said bias current output and said second current source is also operable to supply said first current to the reference voltage generator.

26. Biasing circuitry as claimed in claim 25 comprising a first chopper switch circuit associated with the first current source and a second chopper switch circuit associated with the second current source, wherein each chopper switch circuit is operable to selectively providing a current produced by the respective current source to the control circuitry of the reference voltage generator or to a bias current output.

27. Biasing circuitry as claimed in claim 26 wherein the first and second chopper switch circuits are configured to be switched by clock signals which are in phase with a control clock signal used to control switching of the switched DC-DC converter.

28. Biasing circuitry as claimed in claim 25 comprising a second switch between said drive node and a control node of said first current source wherein said switch control circuitry is configured to control said second switch in use when said first current source is providing said bias current to cyclically open and close said second switch such that the second switch is open during a time window that includes the time at which the switched DC-DC converter switches from the first state to the second state.

29. Biasing circuitry as claimed in claim 28 wherein said switch control circuitry controls said first and second switches such that:

for each transition of the DC-DC converter from the first state to the second state, at least one of the first and second switches is open during a time window that includes the time of said transition; wherein:

at least the second switch is open, if following said transition the first current source will provide the bias current; and at least the first switch is open, if following said transition the second current source will provide the bias current.

30. Biasing circuitry as claimed in claim 28 further comprising a second bias control capacitor for maintaining the voltage of a control node of the first current source when the second switch is open.

31. Biasing circuitry as claimed in claim 1 wherein said associated signal processing circuitry comprises an amplifier.

32. Biasing circuitry as claimed in claim 1 further comprising a MEMS transducer connected to be biased by said biasing circuitry.

33. Biasing circuitry as claimed in claim 1 further comprising said signal processing circuitry associated with the MEMS transducer connected to be biased by said biasing circuitry.

34. Biasing circuitry as claimed in claim 33 wherein said signal processing circuitry associated with the MEMS transducer connected to be biased by said biasing circuitry comprises an amplifier for amplifying signals produced by the MEMS transducer.

35. Biasing circuitry as claimed in claim 1 wherein said switched DC-Dc converter is a charge pump.

36. Control circuitry for a MEMS transducer comprising biasing circuitry as claimed in claim 1 for generating a biasing voltage for biasing the MEMS transducer and amplifier circuitry for amplifying a measurement signal from said MEMS transducer, wherein the bias current generated by said bias current source is provided to said amplifier circuitry.

37. An integrated circuit comprising biasing circuitry as claimed in claim 1.

38. An integrated circuit as claimed in claim 37 wherein said MEMS transducer is formed on a monolithic substrate with said integrated circuit.

39. An electronic device comprising biasing circuitry as claimed in claim 1.

40. An electronic device as claimed in claim 39 wherein said device comprises at least one of: a portable device; a battery powered device; a computing device; a communications device; an audio device; a personal media player; a games device; a mobile telephone; a laptop computer and a tablet computing device.

41. A method of biasing a MEMS transducer and associated signal processing circuitry, the method comprising:

generating, using a reference voltage generator, a reference voltage at a reference voltage node, wherein generating said reference voltage comprises generating a first drive signal at a drive node to control a first current source supplying a first current to the reference voltage generator;

operating a switched DC-DC converter having a voltage input connected to said reference voltage node to provide a bias voltage for said MEMS transducer at a voltage output node, wherein operating said DC-DC converter comprises cyclically switching in a sequence of states including at least a first state where a first converter capacitance is disconnected from the said voltage input followed by a second state where said first converter capacitance is connected to said voltage input; and controlling a second current source current source to supply a bias current to a bias current output by controlling a voltage at a bias control node;

wherein controlling said second current source comprises operating a first switch connected between said drive node and said bias control node to cyclically open and close said first switch such that the first switch is open during a time window that includes the time at which the switched DC-DC converter switches from the first state to the second state.

42. Biasing circuitry for a MEMS transducer and associated signal processing circuitry, comprising:

a reference voltage generator for generating a reference voltage at a reference voltage node, the reference voltage generator comprising control circuitry for generating a first drive signal at a drive node to control a first bias current source to supply a first current;

a switched DC-DC converter, for generating a bias voltage for biasing said MEMS transducer, comprising at least a first converter capacitance coupled via at least a first converter switch to the reference voltage node;

a second bias current source controlled by a voltage at a bias current control node;

a second switch coupled between the bias current control node and the drive node; and switch control circuitry configured to:

provide a first switch control signal to said first converter switch to cyclically disconnect and reconnect the reference voltage node and said converter capacitance; and provide a second switch control signal to said second switch to cyclically open and close the second switch such that the second switch is open during a time window that includes the instant when the reference voltage node is reconnected to the converter capacitance.

43. Biasing circuitry for a MEMS transducer comprising:

a reference voltage generator comprising a reference voltage output and a bias current control output;

a switched DC-DC converter comprising a first converter capacitance coupled to said reference voltage output via a first converter switch and operable in a repeating switch cycle where said first converter switch is on for part of the cycle and off for part of the cycle;

a bias current source coupled to said bias current control output via a second switch; and switch control circuitry configured to turn off said second switch for a portion of each cycle overlapping the instant each cycle when first converter switch is turned on.

44. Bias generation circuitry, for biasing a MEMS transducer and associated signal processing circuitry, comprising:

a reference voltage generator for generating a reference voltage ($V_{BG}$) at a reference voltage node and a control voltage for a current source at a control voltage node;

a switched DC-DC converter for having an input connected to said reference voltage node and an output for outputting a bias voltage for biasing said MEMS transducer, said converter comprising at least one converter capacitor coupled via a first switch to input, wherein said first switch is operated cyclically by a first switch control signal so as cyclically recharge said at least one converter capacitor;

a first current source coupled to said control voltage node via a second switch, said first current source being configured to provide a bias current to said signal processing circuitry; and switch control circuitry configured to open and close said second switch wherein the disconnection of said control voltage node and said bias control node persists during a period of time that includes the instant in time when said first switch is operated to start recharging said at least one converter capacitor.

* * * * *